US012042104B2

(12) United States Patent
Hung

(10) Patent No.: US 12,042,104 B2
(45) Date of Patent: Jul. 23, 2024

(54) TOILET VENTING

(71) Applicant: Stephen Hung, Livonia, MI (US)

(72) Inventor: Stephen Hung, Livonia, MI (US)

( * ) Notice: Subject to any disclaimer, the term of this patent is extended or adjusted under 35 U.S.C. 154(b) by 124 days.

(21) Appl. No.: 17/882,676

(22) Filed: Aug. 8, 2022

(65) Prior Publication Data

US 2023/0301473 A1 Sep. 28, 2023

Related U.S. Application Data

(60) Provisional application No. 63/322,692, filed on Mar. 23, 2022.

(51) Int. Cl.
*A47K 13/30* (2006.01)
*E03D 9/052* (2006.01)

(52) U.S. Cl.
CPC ..... *A47K 13/307* (2013.01); *E03D 9/052* (2013.01)

(58) Field of Classification Search
CPC .. E03D 9/052; E03D 9/05; E03D 9/04; A47K 13/307
See application file for complete search history.

(56) References Cited

U.S. PATENT DOCUMENTS 2,105,794 A 1/1938 Norris
3,533,111 A 10/1970 Bowman et al.
3,649,972 A 3/1972 Sowards
3,763,505 A 10/1973 Zimmerman
4,049,366 A 9/1977 Becker
4,590,629 A 5/1986 Lusk
4,876,748 A 10/1989 Chua
4,882,790 A 11/1989 Ricard
4,944,045 A 7/1990 Agelatos et al.
5,010,600 A 4/1991 Prisco
5,029,346 A * 7/1991 Fernald, Sr. ..... E03D 9/052 4/348
5,031,259 A 7/1991 Baiera et al.
5,079,782 A 1/1992 Sim
5,125,119 A 6/1992 Munoz
5,161,262 A 11/1992 Quaintance, Sr.
5,170,512 A 12/1992 Prisco
5,199,111 A 4/1993 Antepenko
5,201,079 A 4/1993 Sowards
5,305,472 A 4/1994 Eger
5,353,443 A 10/1994 Sim
5,369,812 A 12/1994 Trombley
5,452,481 A 9/1995 Meyer
5,491,847 A 2/1996 Shaffer
5,519,899 A 5/1996 Taylor
5,522,093 A 6/1996 Schaffer
(Continued)

FOREIGN PATENT DOCUMENTS

WO 2013126992 A1 9/2013

*Primary Examiner* — Erin Deery
(74) *Attorney, Agent, or Firm* — MacMillan, Sobanski & Todd, LLC

(57) ABSTRACT

A toilet venting system that is designed to remove malodorous air from one or more toilets. The toilet venting system may be a kit that a user may self-install to a toilet, which may be a conventional toilet, or may be integrated into a new toilet. The toilet venting system and kit may have components for removing malodorous air from a single toilet or multiple toilets. The toilet venting system and kit may also be configured to remove odors to sanitary drain pipes or vent to an outside of a building.

30 Claims, 18 Drawing Sheets

(56) References Cited

U.S. PATENT DOCUMENTS 5,530,971 A 7/1996 Anderson
5,638,553 A 6/1997 Loewen et al.
5,652,969 A 8/1997 Taylor
5,704,074 A 1/1998 Baldea
5,715,543 A 2/1998 Sim
5,724,682 A 3/1998 Johnson
5,727,263 A 3/1998 Hugo Ceja Estrada
5,809,581 A 9/1998 Brown
5,850,638 A 12/1998 Her
5,875,496 A 3/1999 Schaffer
5,875,497 A 3/1999 Lovejoy
5,991,933 A 11/1999 Schaffer
6,052,837 A 4/2000 Norton et al.
6,082,979 A * 7/2000 Friedman ..... E03F 1/006 417/413.1
6,209,146 B1 4/2001 Gonzalez
6,219,853 B1 4/2001 Johnson
6,260,214 B1 7/2001 Smith
6,279,173 B1 8/2001 Denzin et al.
6,370,702 B1 4/2002 Iddings, Sr.
6,463,595 B2 10/2002 Prisco et al.
6,523,184 B2 2/2003 Prisco
6,584,620 B1 7/2003 Reutov et al.
6,694,534 B2 2/2004 Stone
6,772,449 B1 * 8/2004 Wolfe ..... E03D 9/05 4/213
6,795,980 B1 * 9/2004 Ries ..... A47K 13/307 4/217
6,804,837 B1 10/2004 Guess, Sr.
6,928,666 B1 8/2005 Schaffer
7,117,548 B1 10/2006 Reyes
7,120,942 B2 10/2006 Kline et al.
7,316,038 B2 1/2008 Egeresi
7,380,292 B1 6/2008 Harris
7,461,410 B1 12/2008 Shaffer
7,854,027 B1 12/2010 Dugat, III
7,987,527 B1 8/2011 Shumaker
8,239,973 B1 8/2012 Character
8,434,170 B1 5/2013 Ramos
D692,995 S 11/2013 Cogswell
9,290,920 B2 3/2016 Willburn et al.
9,512,604 B1 12/2016 Hunter
9,683,358 B1 6/2017 Coury
10,168,679 B2 1/2019 Tyson
10,188,246 B1 1/2019 Ciotic
10,835,090 B2 11/2020 Payziev et al.
11,166,606 B1 11/2021 Suiter
11,293,172 B1 * 4/2022 Jones ..... E03D 9/052
2005/0273917 A1 12/2005 Lapossy
2006/0041995 A1 3/2006 Toth
2007/0234469 A1 10/2007 Denkewicz, Jr. et al.
2007/0256219 A1 11/2007 Ellinger
2008/0066220 A1 3/2008 Shaul
2008/0216220 A1 * 9/2008 Markaj ..... A47K 13/307 251/12
2009/0028748 A1 1/2009 Edwawrds et al.
2009/0089920 A1 4/2009 Quick
2009/0235441 A1 * 9/2009 Spadola ..... E03D 9/052 4/213
2010/0299822 A1 * 12/2010 Vargas ..... E03D 1/263 4/354
2012/0023650 A1 2/2012 Azodi
2013/0086736 A1 * 4/2013 Larouche ..... E03D 9/052 4/348
2014/0165279 A1 6/2014 Plugovoy
2014/0338114 A1 11/2014 Zheng
2015/0107009 A1 4/2015 Quick et al.
2015/0337820 A1 11/2015 Cai et al.
2018/0148916 A1 5/2018 Kim
2019/0094826 A1 3/2019 Tyson
2019/0194926 A1 6/2019 Liu
2019/0345706 A1 11/2019 Casarez
2020/0325670 A1 10/2020 Phillips, Jr.

* cited by examiner

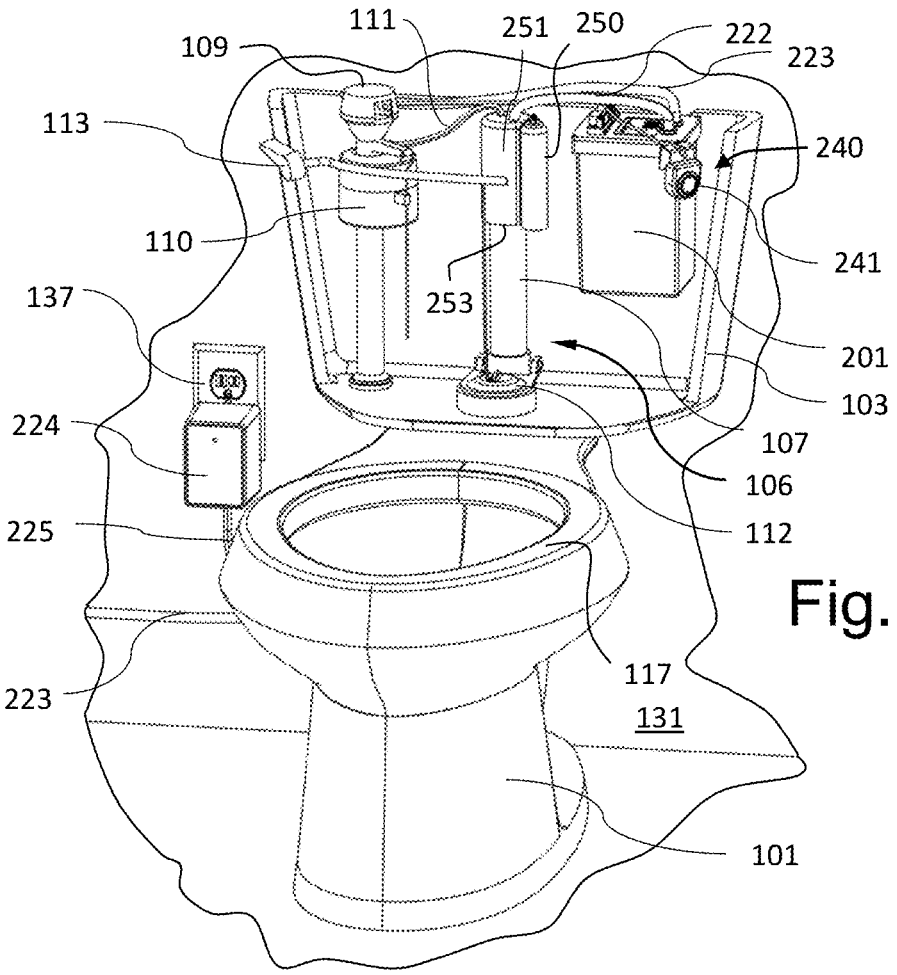
Fig. 5
Fig. 6
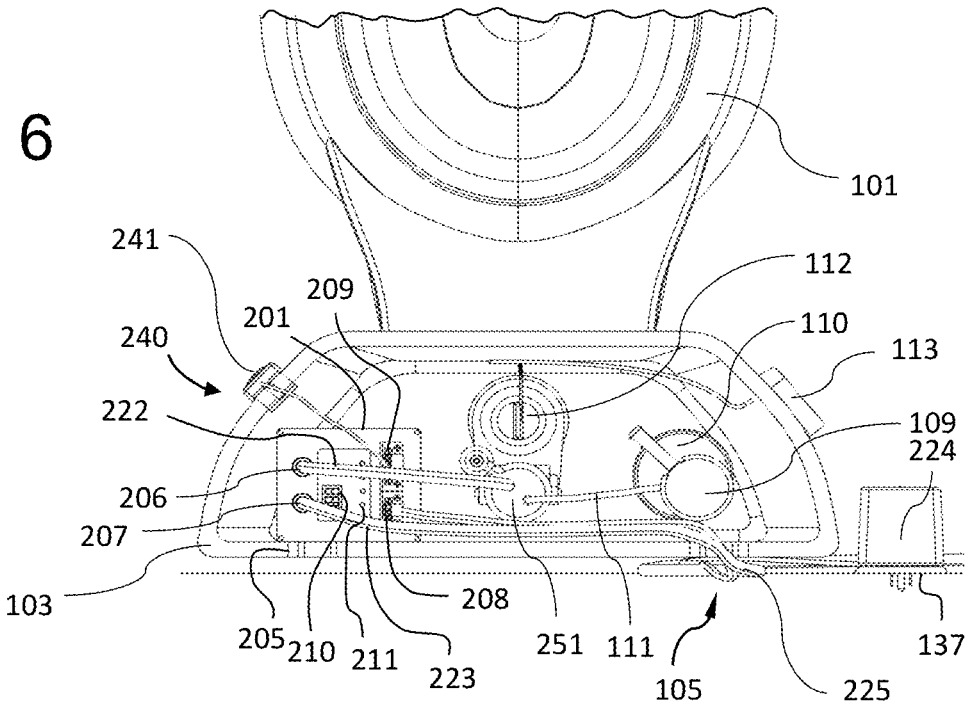

Fig. 32
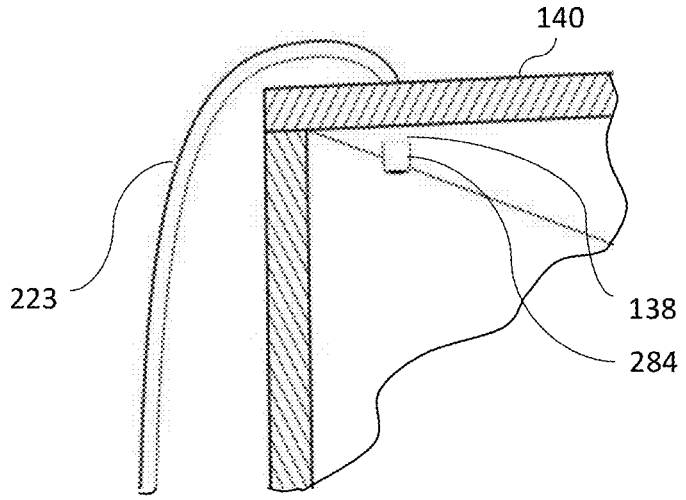
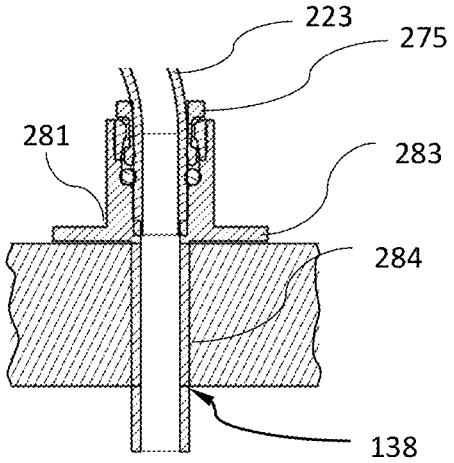
Fig. 33
Fig. 34
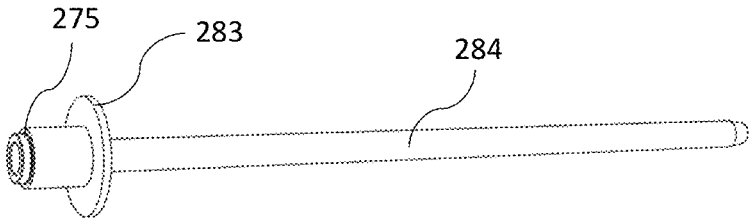

TOILET VENTING

CROSS REFERENCE TO RELATED APPLICATIONS

The present application claims the benefit of U.S. provisional patent application 63/322,692, filed Mar. 23, 2022, the contents of which are incorporated herein in their entirety.

TECHNICAL FIELD

This invention relates generally to toilets, and more particularly to addressing odor that may emanate from a toilet.

BACKGROUND OF THE INVENTION

At a rudimentary level a typical toilet assembly is comprised of a bowl, water holding tank, fill valve and float control allowing for the inflow of water to the tank, flush valve allowing for rapid water outflow from the tank to the bowl, flushing lever, and an overflow pipe or canister body that is linked for fluid transfer to the flush passages of the bowl for refill after each flush and to prevent the tank from overflowing in the event of a malfunctioning fill valve.

A typical method for removing offensive toilet odors from bathrooms utilizes an overhead mounted exhaust fan that draws air from the room interior and expels it through a dedicated venting duct to the building exterior. Typically a primary function of this type of ventilation system is for the removal of moisture laden air rather than odor, with the fan component being sized based on the total volume of the enclosed room and with the fan positioned centrally to optimize air collection from all regions of the room. However, this may not be an ideal configuration for removing offensive odors which emanate from the toilet bowl. In such a general purpose venting system, odors permeate through the entire room while being drawn towards the ventilation fan for extraction. This permeation also allows for the odors to escape into adjoining rooms through any open doorways.

Since the widespread adoption of the standard gravity flush toilet assembly previously described, many inventors have proposed and developed solutions to address the toilet odor problem. However, most of these have failed to achieve commercial success for a variety of reasons and as a result the adoption of toilet odor removal systems is nearly nonexistent as a percentage of the total number of toilets installed worldwide at the time of this disclosure. The lack of a viable commercial solution to effectively capture toilet odors at the source has resulted in the adoption of chemical solutions to mask or neutralize the odor or the use of more powerful or constantly running exhaust fans. Such solutions have proven to be less effective than desired, with potential significant drawbacks.

Some have proposed ventilation systems that target extraction of odor at the toiled boil. In general, solutions that seek to extract toilet bowl odor may have five components—an apparatus for drawing the malodorous air from the bowl, an air moving device, power source, control switch, and an apparatus for exhausting or treating the malodorous air. Where electrical components of the system are positioned in a manner where the risk of immersion or exposure to water is high, the system is typically designed to operate using a low voltage power supply. These solutions can also be largely categorized into two groups: 1) Those that do not require physical modifications to the most common types of toilet assemblies or building structure; and 2) those requiring a specially designed or modified toilet and, in most cases, accompanying additions/modifications to existing building ventilation structure. These two groups also tend to demark the low and high ends of the total installed system cost range as complexity increases moving from the first solution set to the second.

Within the scope of the first category, attempted solutions may utilize attachable air intake shrouds, portable air movers, and activated carbon filter media to treat the malodorous air before returning the air to the room. The apparatus may often be delivered as a ready to mount appliance or install kit requiring no other significant modifications to the toilet, building wall structure, or ventilation duct work. Such an apparatus appears to be disclosed by Ellinger, U.S. Pat. US20070256219A1, which appears to employ an air mover with built-in carbon filter, battery pack for power, and a special toilet bowl rim mounting hook that incorporates air intake passages. Similar solutions appear to be disclosed by Casarez, U.S. Pat. US 20190345706A1, and Meyer, U.S. Pat. No. 5,452,481A, which appears to include an intake shroud that is positioned at the toilet seat mounting position and is connected to a floor or bracket mounted air mover with built in carbon filter. Denzin et al., U.S. Pat. No. 6,279,173B1, appears to disclose an air mover mounted internally within the toilet water tank, with built in filter and intake shroud that encapsulates the overflow tube allowing for the use of existing water flow passages to extract the malodorous air directly from the bowl.

The potential advantages of the types of attempted solutions in the first category may be low cost, compatibility with many conventional toilet brands and models, and relative ease of installation. The potential disadvantages of these attempted solutions may include a need for ongoing maintenance to change filter media, to swap or recharge batteries, to clean added components that may trap dirt or collect residue, a loss of toilet design aesthetics due to add-on components that are often prominently visible, or combinations thereof. A need to purchase replacement batteries and/or filter elements that are of proprietary design may also add to ongoing costs that have deterred consumers from adopting these attempted solutions on a larger scale.

The second category is comprised of attempted solutions where special design features or added components have been added to the previously described conventional toilet assembly, or where modifications to the overall room or building ventilation are often required, or both. A system disclosed by Norris, U.S. Pat. No. 2,105,794, appears to describe an air mover designed as a toilet tank cover, drawing malodorous air from the bowl through built-in air passages, and exhausting into a vent pipe situated inside a wall adjacent to where the toilet is installed. Hugo Ceja Estrada, U.S. Pat. No. 5,727,263, appears to disclose a similar system where a special toilet bowl design allows for malodorous air to be drawn through an externally mounted air mover and discharged to a building vent pipe. Another subset of attempted solutions utilizes special toilet bowl designs that appear to include built-in air passages to the toilet bowl drain as a method for malodorous air to be exhausted, as proposed by Lapossy, U.S. Pat. US 2005/0273917 A1; Sim, U.S. Pat. No. 5,715,543; and Azodi, U.S. Pat. US 2012/0023650 A1. The use of existing building drainage pipes for the removal of malodorous air appears to have been disclosed by Character, U.S. Pat. No. 8,239,973 B1, and Sowards, U.S. Pat. No. 3,649,972, where a special toilet seat design with air intake passages is used to draw in malodorous air for an externally mounted air mover and utilizing an adjacent bathroom sink drain for exhausting air. For prior systems that utilize existing sanitary plumbing for malodorous air ventilation, backflow prevention of sewer gases may be needed, which also increases the complexity of the apparatus.

The potential advantages of the "special toilet system design" solutions of the second category may include that no additional maintenance is typically required after initial install, the apparatus can be concealed to preserve the aesthetic of the toilet design, and the amount of airflow for odor removal can be increased by exhausting directly to the building exterior or sanitary drainage vent. The potential disadvantages of such systems are the significantly higher costs of the componentry, tooling and molds needed for manufacturing, increased sales and distribution cost, and high system installation costs. In many cases, these solutions may only be economically feasible when incorporated as part of new building construction plans due to the need for dedicated exhaust vent pipes to be included within the building wall and ceiling structures. Also, toilets that are installed in high rise apartment or office buildings where access to an outside exhaust point is not feasible for retrofitting may not allow for practicable installation and operation of such systems.

Additionally, a typical toilet odor removal system may utilize a fan type air mover designed for moving high volumes of air (in the hundreds of liters per minute range), such as for example, a ceiling mounted bathroom fan, and accordingly requiring larger exhaust pipe or duct that is proportional in cross-sectional area to the fan diameter and air pressure being generated. Fan type air movers may also be prone to failure when exposed to high levels of humidity or direct exposure to moisture, which may be the operating environment in, for example, a bathroom.

SUMMARY OF THE INVENTION

The invention being disclosed addresses issues that have been previously identified that have hindered adoption of toilet odor ventilation systems.

According to an aspect, an embodiment provides odor removal from a toilet while minimizing ventilation air flow to accomplish the odor removal. Such an odor removal system may reduce costs, complexity and more easily operatively engage existing toilet installations.

According to an aspect, an embodiment provides an apparatus and method that not only works well from a functional standpoint but also has a relatively low total cost of ownership, requires little or no maintenance, minimally negatively affects the aesthetics of bathroom décor, and works with a wide range of existing toilet installations.

According to an aspect, an embodiment provides for cost effective and feasible solutions to facilitate installation of a toilet venting system where the toilet is located and provide ongoing treatment of the malodorous air.

According to an aspect, an embodiment comprises components provided to an end user in kit form, which are configurable in a manner that best meets individual toilet design and home or building layout. An embodiment may include a kit comprising basic elements of a toilet odor ventilation system, which may include: 1) a specially designed intake shroud that encompasses the toilet tank overflow pipe, which may include a vacuum relief valve; 2) one or more diaphragm type fluid pump elements (configured to work in tandem when multiple pumps are employed) housed in an enclosure (which may include push to connect tubing fittings); 3) small diameter flexible tubing; 4) an electric power source (which may use low voltage) and cable; 5) a control switch (or sensor which may be mounted with a mounting bracket) and signal cable; 6) exhaust ventilation fittings for small diameter tubing to accommodate a variety of exhaust air scenarios, including venting to existing sanitary drainage plumbing, to building exterior, or using a toilet drain flange adapter or multiples of these; and any combination of kit elements 1 to 6.

According to an aspect, an embodiment provides for use of a miniature air pump and small diameter tubing to meet design parameters sufficient for odor removal, while minimizing power used, packaging size and cost. A low air flow solution also may allow one to employ existing sanitary drainage pipes for removal of malodorous air without overloading the air venting capacity of the plumbing drainage system, which may be an important consideration, especially with regard to high density toilet installations such as in high rise apartment or office buildings.

According to an aspect, an embodiment provides for the use of small diameter tubing for removing malodorous air, which may ease installation of a toilet venting system and minimize any esthetic drawback when the tubing is partially exposed. Small tubing for carrying the malodorous air may be more easily "fished" through an existing wall, floor, ceiling or any combination of building structures. Such "fishing" of small diameter air tubing may use similar methods as are used for installing electrical wires in building structures. Moreover, employing small diameter tubing, such as for example ⅜ inch outside diameter (OD) tubing for the air flow, may allow for easier and less expensive installation of the toilet venting system since conventional ⅜-inch O.D. tube fittings are typically readily available, and penetrations through building structure and sanitary pipe during installation may be performed with a standard ⅜-inch sized drill bit.

According to an aspect, an embodiment provides for pumping of malodorous air employing a common pump, such as for example, a diaphragm pump. Additionally, such a pump may be configured to operate despite moisture intake and may incorporate check valves so as to reduce or prevent back flow of air or sewer gasses.

According to an aspect, an embodiment provides for use of existing toilet bowl water passages and a tank overflow pipe on existing conventional toilets to allow for extraction of malodorous air from inside the toilet bowl.

According to an aspect, an embodiment provides for an air intake shroud that may mount on an overflow pipe to cap the overflow pipe opening and may use water in the toilet tank to seal around a bottom of the shroud to create a closed intake air conduit for removing the malodorous air from the toilet bowl. According to an aspect, an embodiment provides for an air intake shroud incorporating a secondary interconnected chamber that houses a float actuated vacuum relief valve, which opens when the toilet tank water level rises to the top of the overflow pipe due to a fill valve water shut off failure, which may help to prevent water from being sucked into the air pump assembly.

According to an aspect, an embodiment provides for a control switch device that may be manually activated to turn an air pump on and off, which control switch device may be touch activated (e.g., push button switch, touch pad, inductive touch) or touchless activated (e.g., infrared, motion or laser proximity sensor), may be illuminated (e.g., lighted around the switch) or not illuminated, may be easily mounted to an exterior wall of the toilet tank, configured for power on/off operation through a wall switch or wired electrically in parallel with existing light or bathroom exhaust fan switches, or any combinations thereof.

According to an aspect, an embodiment provides for a timer module that may be incorporated within the air pump assembly, allowing for automatic shut off after a user adjustable preset delay period.

According to an aspect, an embodiment provides for air tubing connection to conventional drain saddle fittings, which are typically commercially available to connect to standard bath or kitchen sink drainage pipe sizes. According to an aspect, an embodiment provides for air tubing to saddle fittings, which may connect to a larger sanitary drain pipe.

According to an aspect, an embodiment provides for microchannel housings, which may be employed with the toilet venting system. Such a microchannel housing may allow for airflow through tight spaces. Tight spaces may, for example, include toilet locations where access to an existing drainage pipe or building exterior is not practicable. A microchannel housing may channel malodorous exhaust air through a small gap between an underside of the toilet and bathroom floor, exhausting the air into the toilet drain.

According to an aspect, an embodiment provides for an air pump assembly to be installed inside of the toilet tank. Such an air pump assembly may operatively engage air tubing, which may be small diameter, and electrical wiring, which may be low voltage, routed in a relatively inconspicuous manner (e.g., exiting the toilet tank between a wall of the toilet tank and a toilet tank lid).

According to an aspect, an embodiment provides for a toilet venting system that may not need regular maintenance nor filters (eliminating a need to replace filters).

According to an aspect, an embodiment provides for a toilet venting system in a kit form, which may be easily installed on conventional toilets and used in common bathrooms.

According to an aspect, the invention provides a kit for removing malodorous air from at least one toilet, the kit comprising: an intake shroud configured to operatively couple to a tank overflow pipe in a toilet tank, which intake shroud has sides configured to surround an upper portion of the tank overflow pipe and a top surface configured to be supported above a top of the tank overflow pipe to create an internal air chamber between the tank overflow pipe and the intake shroud, and a water refill tube port and an air intake port extending through the intake shroud at a location configured to extend into the internal air chamber and configured to be located above the top of the tank overflow pipe; at least one air pump assembly, configured to receive electrical power to drive an air pump and electronics controlling the air pump, which at least one air pump assembly includes an air intake port for drawing the malodorous air into the air pump; and a flexible intake air tube having a first end operatively engaging the air intake port of the intake shroud and an opposed second end operatively engaging the air intake port of the at least one air pump assembly.

According to an aspect, the invention provides a kit for removing malodorous air from at least one toilet, the kit comprising: an intake shroud configured to operatively couple to a tank overflow pipe in a toilet tank, which intake shroud has sides configured to surround an upper portion of the tank overflow pipe and a top surface configured to be supported above a top of the tank overflow pipe to create an internal air chamber between the tank overflow pipe and the intake shroud; a water refill tube port and an air intake port extending through the intake shroud at a location configured to extend into the internal air chamber and configured to be located above the top of the tank overflow pipe; a vacuum relief port extending through the intake shroud and configured to extend into the internal chamber; and a vacuum air relief valve operatively engaging the vacuum relief port and configured to open when a water level in the toilet tank rises above a predetermined level and close when the water level in the toilet tank drops below the predetermined level; at least one air pump assembly, configured to receive electrical power to drive an air pump and electronics controlling the air pump, which at least one air pump assembly includes an air intake port for drawing the malodorous air into the air pump; and a conduit having a first end operatively engaging the air intake port of the intake shroud and a second end operatively engaging the air intake port of the at least one air pump assembly.

According to an aspect, the invention provides a kit for removing malodorous air from at least one toilet, the kit comprising: an intake shroud configured to operatively couple to a tank overflow pipe in a toilet tank, which intake shroud has sides configured to surround an upper portion of the tank overflow pipe and a top surface configured to be supported above a top of the tank overflow pipe to create an internal air chamber between the tank overflow pipe and the intake shroud, and a water refill tube port and an air intake port extending into the internal air chamber and configured to be located above the top of the tank overflow pipe; at least one air pump assembly, configured to receive electrical power to drive an air pump and electronics controlling the air pump, which at least one air pump assembly includes an air intake port for drawing the malodorous air into the air pump; a conduit having a first end operatively engaging the air intake port of the intake shroud and an opposed second end operatively engaging the air intake port of the at least one air pump assembly; toilet flange exhaust vent fitting having a microchannel structure and configured to be mounted under a base of a toilet bowl, in which the microchannel structure is configured to be narrower than a width of the base of the toilet bowl, wherein the toilet flange exhaust vent fitting is configured to direct malodorous air to a sanitary drain pipe under the toilet; and an exhaust air tubing extending from the at least one air pump assembly to the toilet flange exhaust vent fitting.

According to an aspect, the invention provides a toilet venting system comprising: an intake shroud operatively engaging a tank overflow pipe in a toilet tank, which intake shroud has sides surrounding an upper portion of the tank overflow pipe and a top surface supported above a top of the tank overflow pipe to create an internal air chamber between the tank overflow pipe and the intake shroud, and a water refill tube port and an air intake port extending through the intake shroud extending into the internal air chamber and located above the top of the tank overflow pipe; at least one air pump assembly, configured to receive electrical power to drive an air pump and electronics controlling the air pump, which at least one air pump assembly includes an air intake port for drawing the malodorous air into the air pump; and a flexible intake air tube having a first end operatively engaging the air intake port of the intake shroud and an opposed second end operatively engaging the air intake port of the at least one air pump assembly.

Various aspects of this invention will become apparent to those skilled in the art from the following detailed description of the preferred embodiments, when read in light of the accompanying drawings.

BRIEF DESCRIPTION OF THE DRAWINGS

FIG. 5 is a schematic, partially cutaway, perspective view of a toilet assembly and electrical outlet.

FIG. 6 is a schematic, plan view of a portion of a toilet assembly and electrical outlet.

FIG. 32 is a schematic, partially cutaway, perspective view of a room and a portion of a toilet assembly.

FIG. 33 is a schematic, cutaway, elevation view of a room and a portion of a toilet assembly.

FIG. 34 is a schematic, perspective view of a portion of a toilet assembly.

DETAILED DESCRIPTION OF THE PREFERRED EMBODIMENTS

A detailed description of the preferred embodiment of the invention and common installation methodologies will be described in the following section. A toilet venting system may be configured in a kit form for retrofit to individual toilet installations and building layout, so it is to be understood that the descriptions being provided regarding the configuration of the installed components should not serve to limit the scope or adaptability of the invention for alternate installations of the kit.

Figure 1:
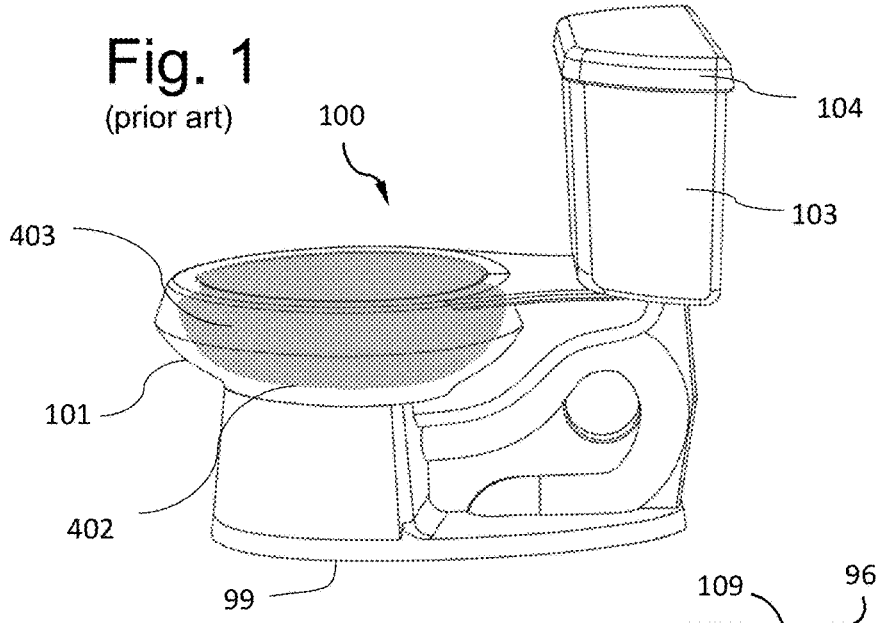
Fig. 1 (prior art)
FIG. 1 is a schematic, perspective view of a toilet, according to prior art.

FIG. 1 illustrates a conventional toilet 100, including a toilet bowl 101, a toilet tank 103, a toilet tank lid 104 and a base 99, which supports the toilet 100 on a floor or other support structure. A toilet bowl volume 402 is illustrated by a shaded area in FIG. 1, with trapped air/gas 403 illustrated as a volume that is essentially trapped when one is sitting on the toilet 100.

Figure 2:
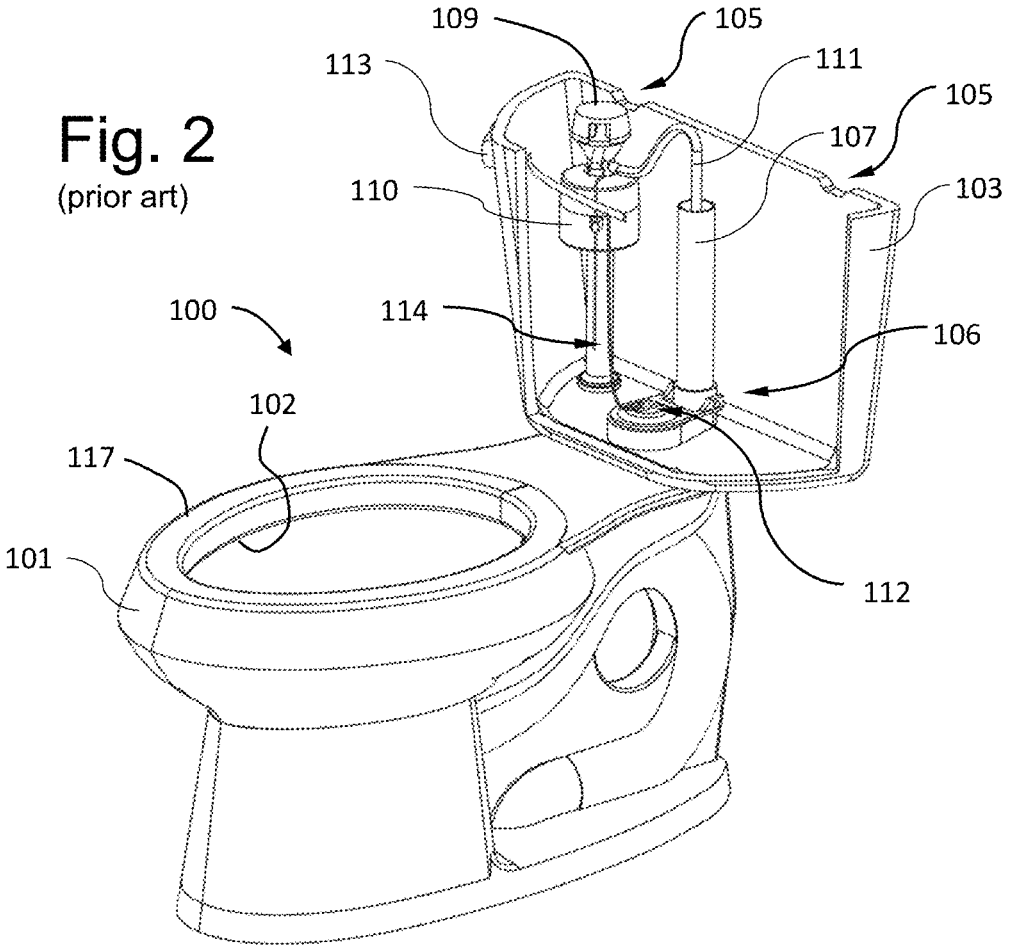
Fig. 2 (prior art)
FIG. 2 is a schematic, partially cutaway, perspective view of a toilet, according to prior art.
Figure 3:
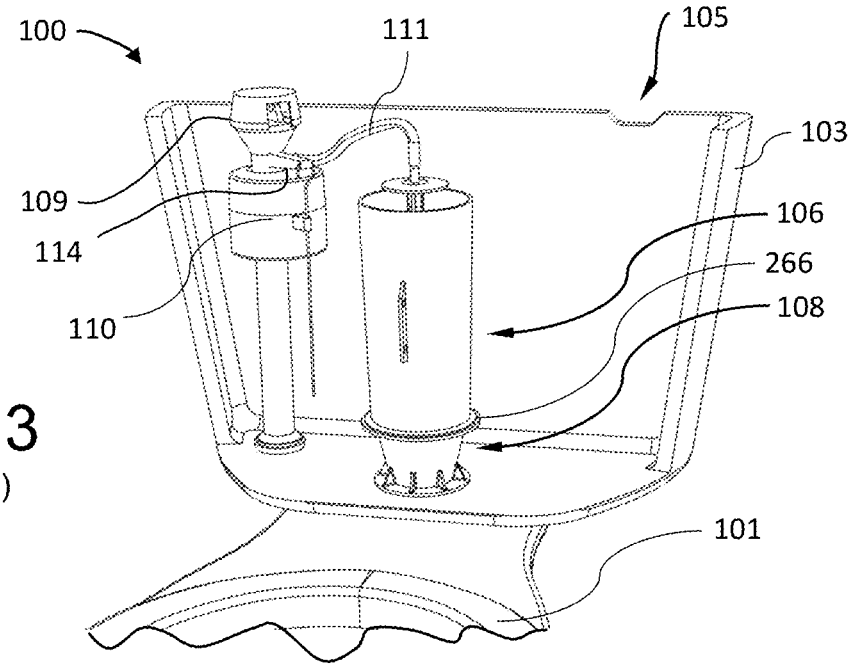
Fig. 3 (prior art)
FIG. 3 is a schematic, partially cutaway, perspective view of a portion of a toilet, according to prior art.
Figure 7:
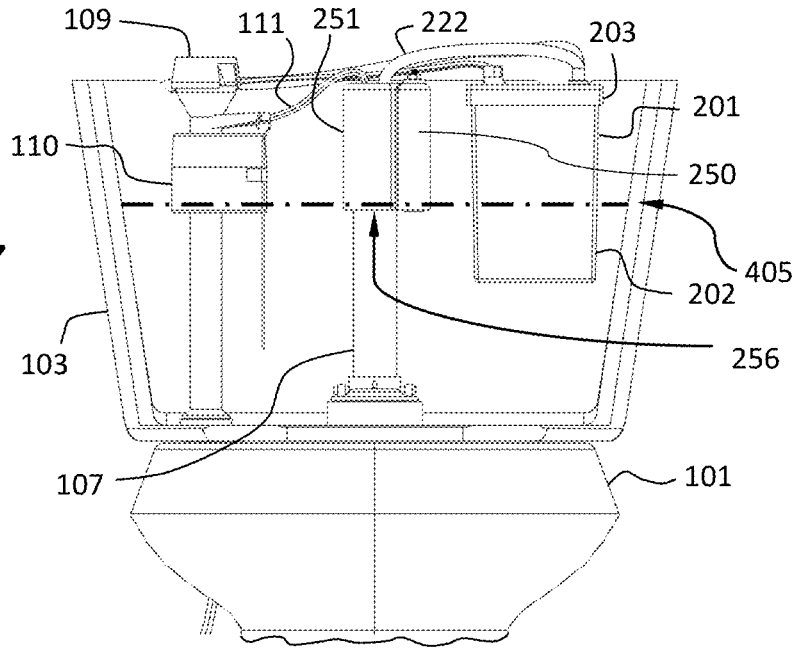
FIG. 7 is a schematic, partially cutaway, elevation view of a portion of a toilet assembly.

FIG. 2 illustrates a typical standard toilet 100 with a gravity fed flushing mechanism, and FIG. 3 illustrates another typical standard toilet 100 with a gravity fed flushing mechanism. The toilets 100 may have an attached toilet tank 103 with water level controlled by a water fill valve 109, flush valve 106, and flush lever 113. The toilet tanks 103 may have a toilet tank ventilation passage 105, which allows for ventilation when a toilet tank lid 104 (see FIG. 1) is resting on top of the respective toilet tank 103. These examples of conventional toilets 100 may utilize a tank overflow pipe 107 (FIG. 2) or canister flush valve 108 (FIG. 3) with overflow passages that have a constantly open air passage connection to flush passages 102 (best seen in FIG. 4) of the attached toilet bowl 101 while in a non-flushing state. Minor variations with the fill valve control assembly (typically a float 110), flush valve water seal (typically a flapper 112 or canister seal 266), or flush lever 113 and flush mechanism 114 are common with these typical toilets 100.

Figure 4:
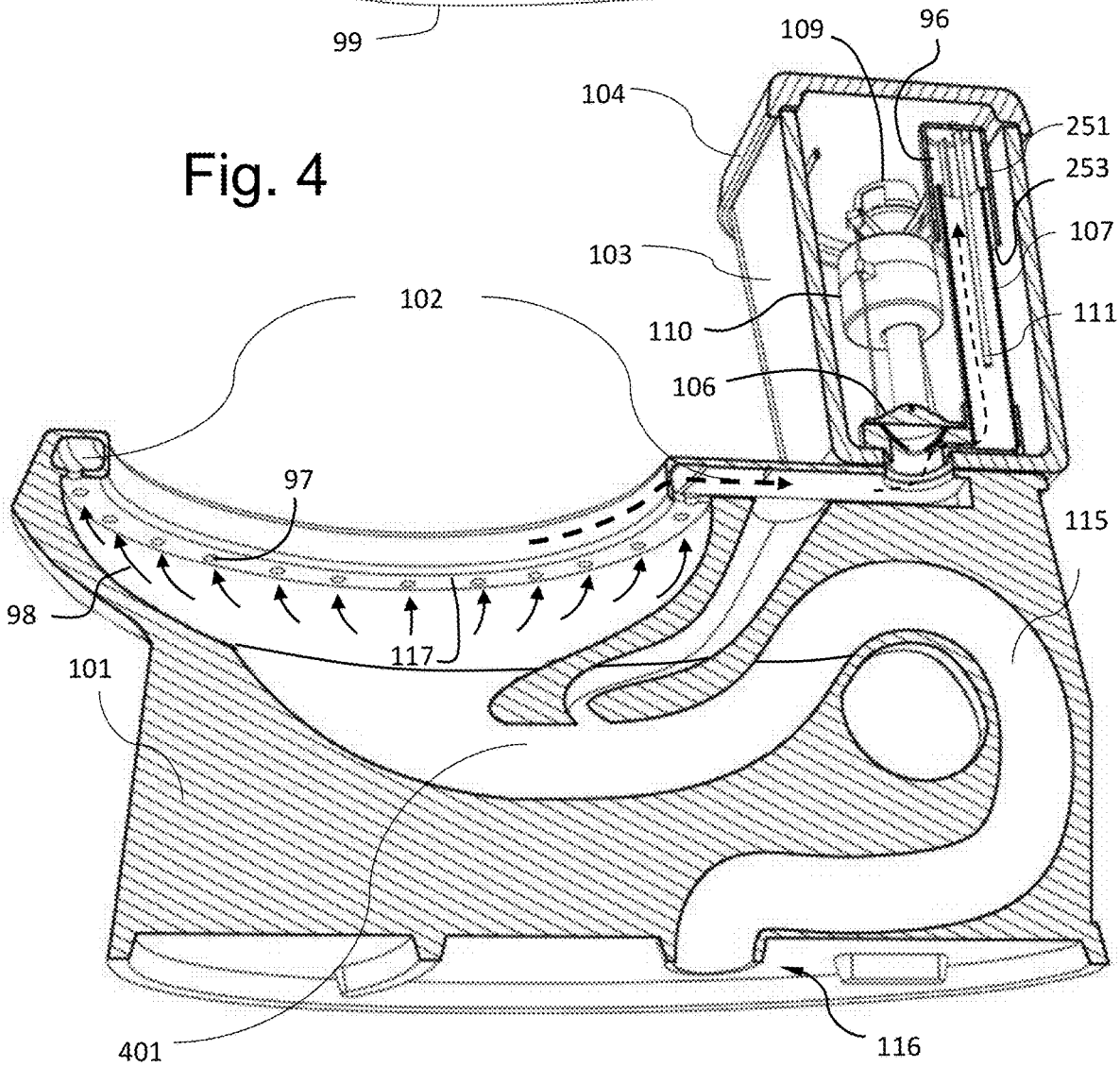
FIG. 4 is a schematic, partially cutaway, perspective view of a toilet.

FIG. 4 illustrates water flush passages 102 typically incorporated into a toilet bowl 101, which may be conventional, with arrows 98 indicating an air extraction flow route. The air extraction flow route 98 allows air flow through the water orifices 97 of a toilet bowl rim 117, flush passages 102, flush valve 106, overflow pipe 107, and leading into a chamber 96 under an air intake shroud 251.

During toilet usage where a person is seated on the toilet, a partially enclosed air space is formed between the person's lower body and the surface of the water contained in the toilet bowl. Depending on the design of the toilet, this air space can range between 8 to 12 liters in volume. As a point of reference, the American National Standards Institute's (ANSI) Z9.5-2012 standard for laboratory fume hood performance recommends a minimum design specification of 150 air changes per hour (or 2.5 air changes per minute) under general conditions. This suggests that an airflow rate of, for example, about 20 to 30 liters per minute (or 0.7 to 1.1 cubic feet per minute) is a reasonable objective for a toilet bowl ventilation apparatus. This relatively low air flow requirement allows for the use of a relatively small air pump and small diameter air tubing to meet the design parameters for venting malodorous air. Implementing a low air flow solution also allows for existing sanitary drainage pipes to be used for malodorous air exhaust as a secondary function without overloading the air venting capacity of the sanitary drainage pipe system, which is one consideration for high density toilet installations such as in high rise apartment or office buildings. To meet an air flow rate for the air tubing, the inside diameter (I.D.) of the tubing may, for example, be able to flow 0.5 liters per second to accommodate a system air flow rate of about 30 liters per minute under minimal pressure conditions (1 bar/1 atm/14.5 PSI). A ¼-inch I.D. tube or larger is an acceptable size to meet this desired flow volume. Accounting for a typical wall thickness, conventional tubing, which may be plastic, with an outside diameter (O.D.) of about ⅜ inch and I.D of about ¼ inch can readily achieve the air flow volume and is a standard size that is readily available commercially. The use of small diameter tubing (e.g., ⅜-inch O.D.) may significantly improve the ease of installation of the toilet venting system. Such small diameter tubing can be easily "fished" through existing walls, floor, and ceiling structures using similar methods for installing electrical wire runs. Additionally, ⅜-inch O.D. tube fittings are readily commercially available and penetrations formed through building structure and sanitary pipe during installation can be performed with a standard ⅜-inch drill chuck and typical ⅜-inch diameter drill bit. An air tube I.D. of ¼ inch may be maintained through an entire length of the air tubing, which may make use of, for example, push-to-connect or similar style connections desirable (in lieu of push on barb style fittings that may reduce the I.D. at the connection point and constrict air flow). However, if smaller I.D. tubing or fittings (e.g., less than ¼ inch) are used for the toilet venting system, the air pump capacity may be increased to increase pressure in the air tube. Somewhat larger diameter tubing may also be employed but may be more difficult to install and may not have push-to-connect tube fittings readily commercially available in sizes larger than ½-inch O.D.

Referring now to FIGS. 4-8, in view of FIGS. 1-4, an air pump assembly 201, which may comprise, for example, an enclosed diaphragm valve 300, which may be employed as a diaphragm type vacuum pump. The air pump assembly 201 may be located, for example, adjacent to or in the toilet 100, supported and positioned within the toilet tank 103. The air pump assembly 201 may be secured to a top of a wall of the tank 103, for example using an s-hook style mounting clip hanger 205. Where there is insufficient space internally within the toilet tank 103 to contain the air pump assembly 201, the pump assembly 201 may be installed externally to the toilet tank 103, mounted externally, for example, on a nearby wall 131 (such as the wall shown, for example in FIGS. 23 and 27), cabinetry 135 (such as the cabinetry shown, for example, in FIGS. 23, 27 and 28), or remotely along an intended exhaust tubing path in an accessible location (within, for example, a basement, an attic, or an adjacent room). The air pump assembly 201 may comprise a motor/pumping assembly 221, which may include an internal housing 231 in which the diaphragm valve 300 is located, and an electric motor 232. The diaphragm valve 300 may be configured for relatively high air flow rate but relatively low output pressure. The diaphragm valve (pump) may have chemical resistance and liquid ingestion capabilities so it won't fail due to moisture intake. Multiple smaller diaphragm valves may be slaved together with one motor as a single pump assembly to increase air flow and combined with additional pump assemblies in series or parallel for increased air volume flow. Other types of pumps for pumping air may be employed instead, if so desired.

Figure 8:
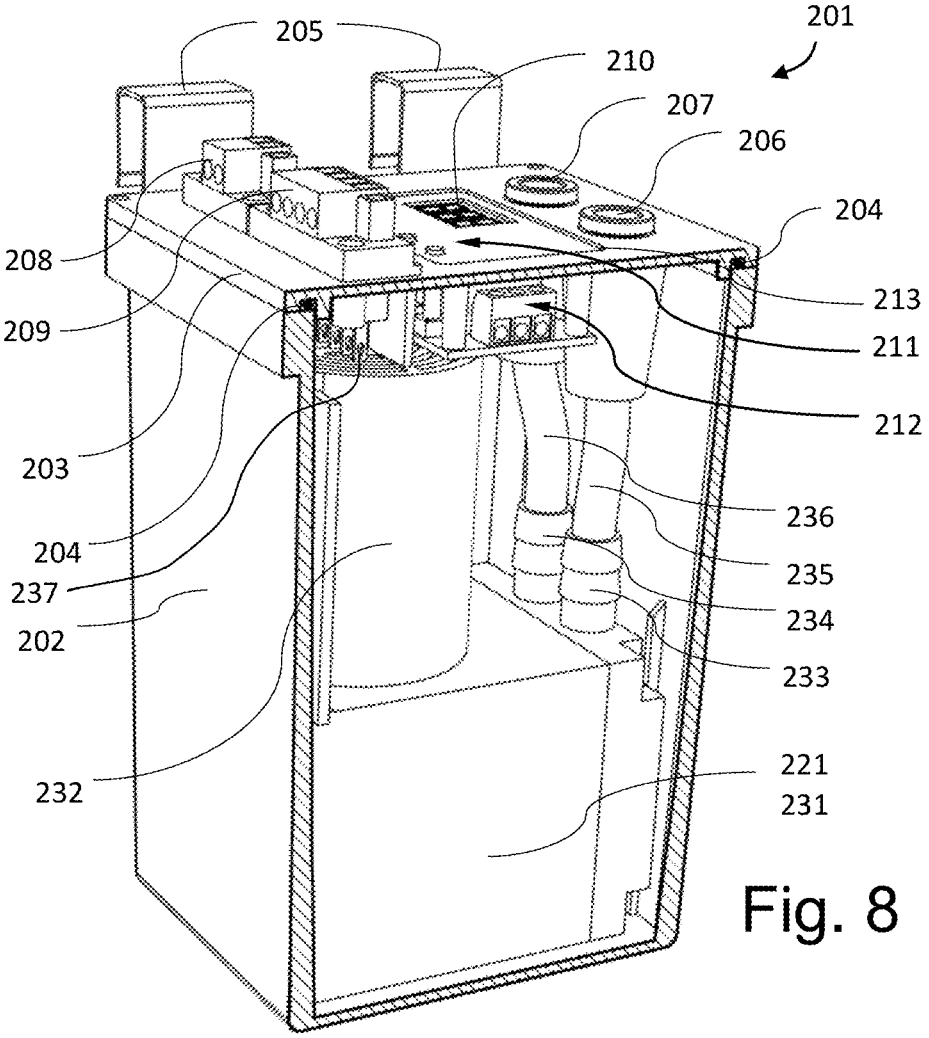
FIG. 8 is a schematic, partially cutaway, perspective view of an air pump assembly.
Figure 9:
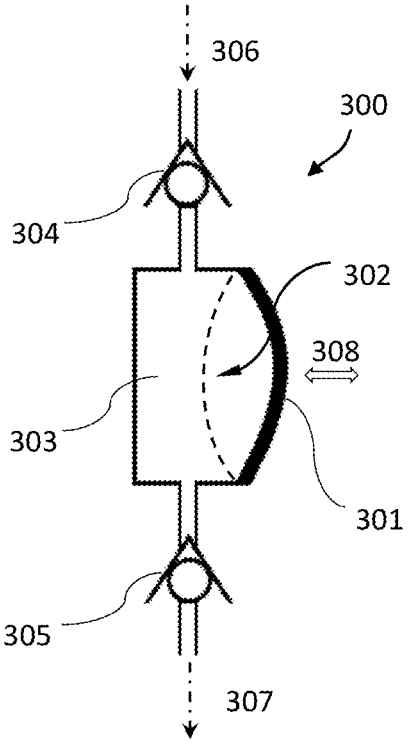
FIG. 9 is a schematic view of a diaphragm valve.
Figure 10:
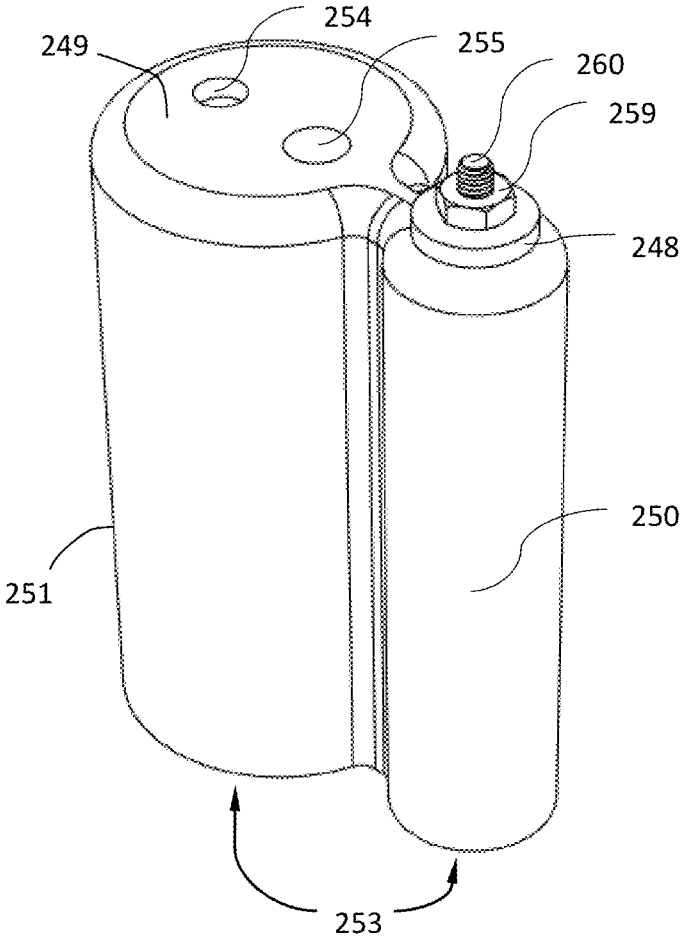
FIG. 10 is a schematic, perspective view of an air intake shroud.
Figure 11:
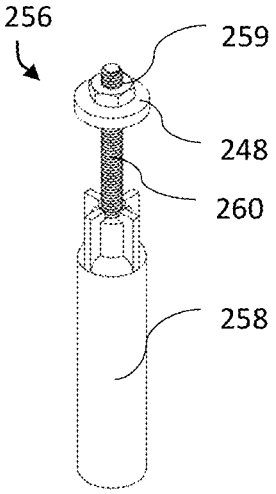
FIG. 11 is a schematic, perspective view of a portion of an air intake shroud.
Figure 12:
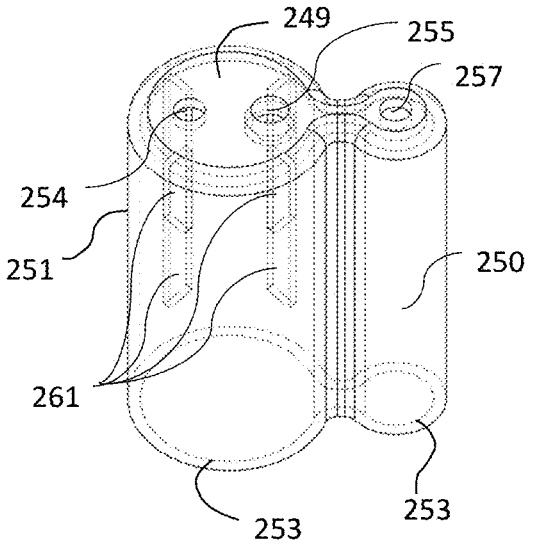
FIG. 12 is a schematic, perspective view of a portion of an air intake shroud, with some internal elements shown.

Referring now to the pump schematic of FIG. 9, diaphragm pump elements that may form the diaphragm valve 300, which may be internal to the motor/pumping unit 221 (illustrated in FIG. 8), may comprise a flexible diaphragm membrane 301 and internal components, which may be resistant to moisture, corrosion and rust. As illustrated by the double arrow, when an external mechanical force 308 is applied to the membrane 301, it displaces the flexible membrane 301 (to a position illustrated by element number 302) into a fixed chamber 303, causing an increase in fluid medium pressure in the fixed chamber 303. Upon increasing the pressure in the fixed chamber 303 due to displacing the flexible membrane 301, a check valve 304 on an inlet side 306 of the fixed chamber 303 may be forced into a closed position, preventing flow therethrough from an inlet side of the diaphragm valve 300, while a check valve 305 on an outlet side 307 of the chamber 303 is opened due to the increased pressure, allowing the pressurized fluid to pass through the outlet side 307 of the diaphragm valve 300. Upon release of the external mechanical force 308, the membrane 301 may then be pulled back mechanically or allowed to spring back naturally to the original position, causing negative fluid pressure within the fixed chamber 303. This negative fluid pressure then causes the inlet check valve 304 to open, allowing fluid to be drawn in through the inlet 306 to fixed chamber 303, while the outlet check valve 305 closes, preventing fluid from entering through the outlet port 307. This cycling of the flexible membrane 301 may be repeated rapidly to generate a pumping action on the fluid the diaphragm valve 300 is acting upon. Multiple diaphragm pump valves 300 may be connected together with a single motor (or multiple motors) in the air pump assembly 201 to provide for increased pumping capacity.

Referring again to FIGS. 5-8, in reference to FIGS. 1-4, a single motor/pumping unit 221 may be employed to reduce complexity, but multiple diaphragm valves 300 (employing one or more motors) may be employed as pump units to achieve increased air flow capacity. The motor/pumping unit 221 may include an air inlet 233 and an air outlet 234. A main air pump enclosure may comprise a main housing 202, with side walls enclosing the motor/pumping unit 221, a lid 203 securable to the main housing 202, and a flexible seal 204 extending around a periphery of the lid 203 and sealing the lid 203 to the main housing 202. A lower portion of the main housing 202 may be made of thermoformed plastic. In addition to the motor/pumping unit 221, the main housing 202 may contain pump inlet tubing 235, pump outlet tubing 236, optional air manifolds, and pump wiring 237. The lid 203 may be made of thermoformed plastic and may be formed with one or more built-in intake port(s) 206 and exhaust port(s) 207, which may be employed for external tubing connections for internal tubing 235, 236 to be inserted and cavities for push-to-connect components, simplifying installation of the tubing. The lid 203 may also include electrical ports 208, 209 and other mountings for electrical connectors. The air pump assembly 201 may comprise a timer relay circuit board 212, which may be mounted for example to the lid 203, with an opening in the lid 203 for a digital readout (display) 210 of the timer relay circuit board 212 and one or more operator interface button(s) 211. Gaps around lid openings for ports and connector bodies may be sealed internally with, for example, an adhesive sealer and adhesive backed membrane plate 213.

Referring to FIGS. 4, 5, 7 and 10-13B, in view of FIGS. 1-3, an intake shroud assembly 251 is illustrated. The intake shroud assembly 251 may be sized to encapsulate, for example, a standard 1 inch to 1½ inch outside diameter (O.D.) overflow pipe 107, leaving a lower opening (gap) 253 between the intake shroud assembly 251 and the overflow pipe 107, which allows for water to enter through the opening (gap) 253 and flow into the top of the overflow pipe 107 at maximum fill valve water flow rates during a tank overflow event. A tank overflow event is a condition where the water level in the toilet tank 103 reaches the top of the overflow pipe 107 and flows into the overflow pipe 107 in order to prevent the water level in the toilet tank 103 from reaching the top of the walls of the toilet tank 103. The components of the intake shroud assembly 251 may be made of, for example, thermoformed or cast plastic, which may provide for low cost, durability, and moisture resistance. A top surface 249 of the shroud assembly 251 may include a fitted opening 254 for, for example, a standard 5/16-inch O.D. refill tube 111 to pass through and extend, for example, about 100 millimeters down into the overflow pipe 107 (best see in FIGS. 13A and 13B). A hole (connection point) 255 through the top surface 249 of the shroud 251 may be provided for an intake air tube 222, which may have, for example, a ⅜-inch O.D., leading to the intake port 206 of the pump assembly 201. The air intake shroud 251 may include internal shroud support ribs 261 (best seen in FIG. 12), which may extend radially inward to a diameter that is less than an outside diameter of the tank overflow pipe 107. The widths of the support ribs 261 may be sized so that the bottom edges of each rib 261 will contact the top of the overflow pipe 107 to support the intake shroud 251 at a desired vertical spacing. These internal shroud support ribs 261, then, space the top surface 249 of the air intake shroud 251 a set distance above the top of the tank overflow pipe 107, defining an internal air chamber 96. Additional side forces, which may be exerted by the refill tube 111 and intake air tube 222, may fix a position horizontally of the intake shroud 251 relative to the overflow pipe 107.

The open bottom (gap) 253 of the shroud 253 may sealed from air by both the lower water level 405 and the higher water level 406 (best seen in FIGS. 13A and 13B) within the toilet tank 103. With the water providing a seal from air at the open end (gap) 253, a low air pressure region may be formed in the internal air chamber 96 within the shroud 253 when the air pump assembly 201 is activated. This low air pressure region within the shroud 253 allows the air pump assembly 201 to draw air from the toilet bowl passages 102 upwards through the overflow pipe 107. The overflow pipe 107, during typical toilet operations, is not filled with water, allowing for air to flow from the toilet bowl 101 to the air pump assembly 201 via the toilet bowl passages 102 and the overflow pipe 107.

Figure 13A:
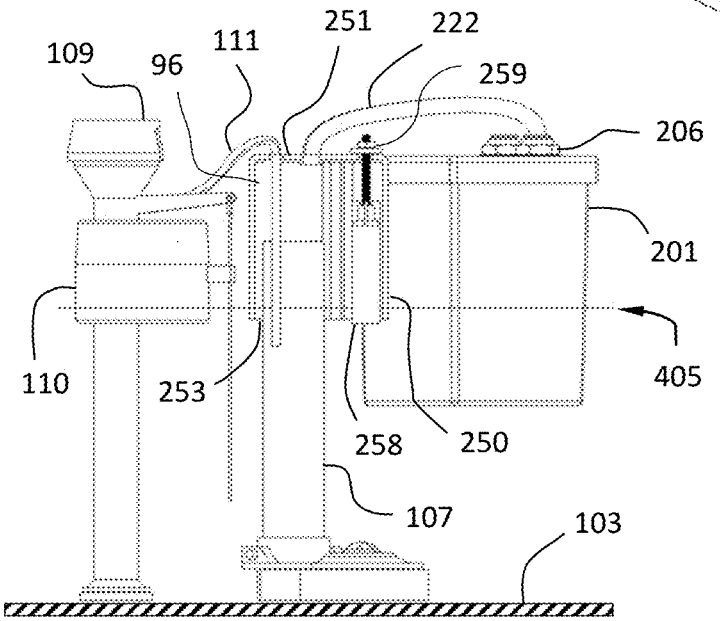
FIG. 13A is a schematic, elevation view of a portion of a toilet assembly.
Figure 13B:
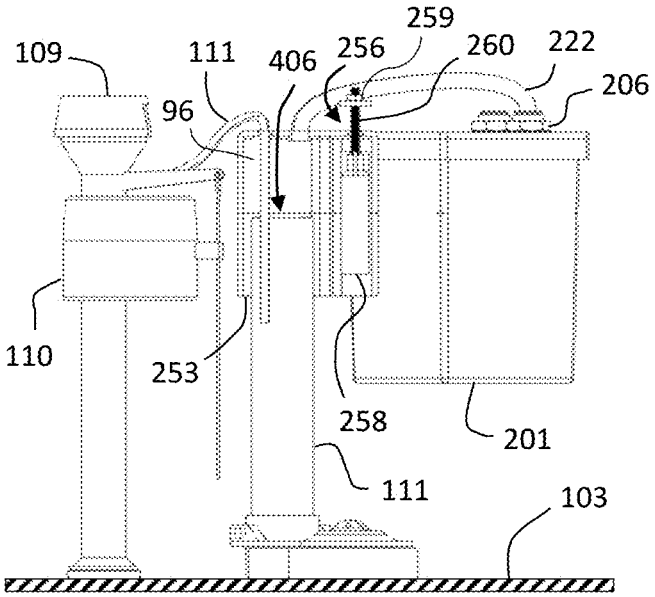
FIG. 13B is a schematic, elevation view of a portion of a toilet assembly.

During a toilet flush event, the water level 405 (as illustrated in FIG. 13A) in the air intake shroud 251 may move upward to the top of the overflow pipe 107 to fill the overflow pipe 107 in order to equalize with the lower level of the tank water 405, even as the water in the toilet tank 103 is draining away into the toilet bowl 101 while the flush valve 106 is open. If this happens, the shroud 251 may be completely sealed from air, with no open airflow passages 102, causing the water level within the shroud 251 to rise due to the vacuum pressure in the internal air chamber 96 generated in the shroud 251 by the air pump assembly 201. In such a situation, when the water level is similar to water level 406 (as illustrated in FIG. 13B) the water may eventually be sucked into the motor/pumping unit 221 via intake air tube 222. While this moisture will not damage a diaphragm type motor/pumping unit 221 (or other types of properly configured air pumping units), performance may be somewhat degraded. In order to limit or prevent any potential degradation by limiting or preventing water from being sucked into the motor/pumping unit 221, the user may adjust the lower fill level of the water level 405 in the toilet tank 103 so that only about a few millimeters of the shroud lower opening 253 is submerged (at the time the water fill valve 109 stops water flow into the toilet tank 103 at the end of a toilet flush event). Such an adjustment may allow the shroud 251 to be unsealed for air relief through the lower opening (gap) 253 as quickly as possible after the start of a toilet flush event, before the water level within the shroud 251 can rise (due to the vacuum pressure from the air pump assembly 201) to reach the air intake port 255. The enclosed air volume of the intake shroud 251 may be configured in accordance with the vacuum air flow rate of the pump 201 to provide sufficient time for the lower opening (gap) 253 of the shroud 251 to be unsealed by the rapidly dropping water level in the toilet tank 103 during the initialization of a flush event.

The air intake shroud 251 may comprise an interconnected secondary chamber 250, which houses a float 258 that is part of a vacuum relief valve 256 (best seen in FIGS. 10, 11, 13A and 13B). The vacuum relief valve 256 is configured to open a vacuum relief port 257 (best seen in FIG. 12) in the secondary chamber 250 in cases when, during a toilet flush event, the high tank water level 406 (FIG. 13B) rises to the top of the overflow pipe 107 due to a fill valve 109 water shut off failure. Without the vacuum relief valve 256, during a fill valve 109 water shut off failure, water flowing into the overflow pipe 107 may completely block airflow, causing the water level in the shroud 251 to rise due to vacuum pressure from the air pump assembly 20 land resulting in water being sucked into the air intake port 255. The water level at which the vacuum relief valve 256 may be activated may be set, for example, using a threaded rod 260 and adjustment nut 259 to adjust when a seal 248 lifts off the vacuum relief port 257. FIG. 13A illustrates a closed position of the vacuum relief valve 256 at lower tank fill level 405, with the seal 248 blocking the vacuum relief port 257, while FIG. 13B illustrates the vacuum relief valve 256 open, with the seal 248 lifted from the vacuum relief port 257, when the high water level 406 is slightly above the overflow pipe 107.

Figure 14:
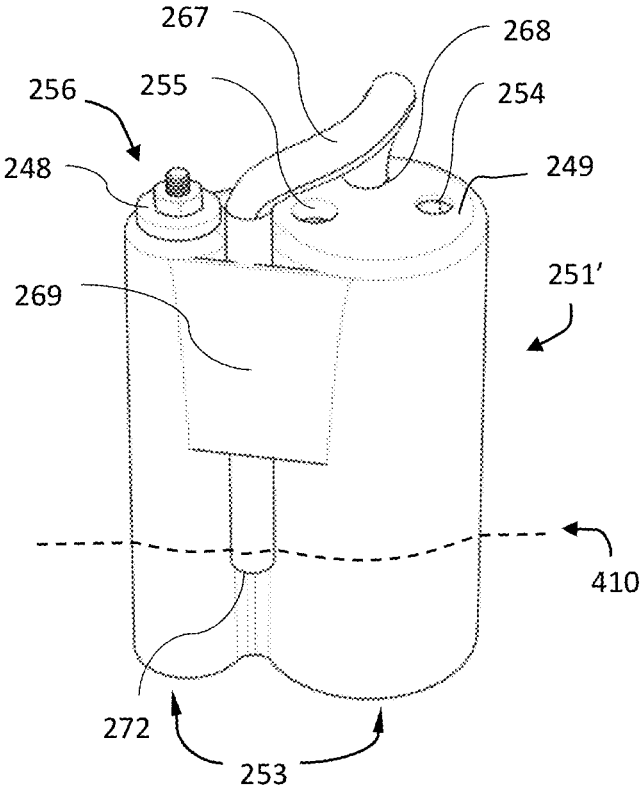
FIG. 14 is a schematic, perspective view of a portion of an air intake shroud.
Figure 16:
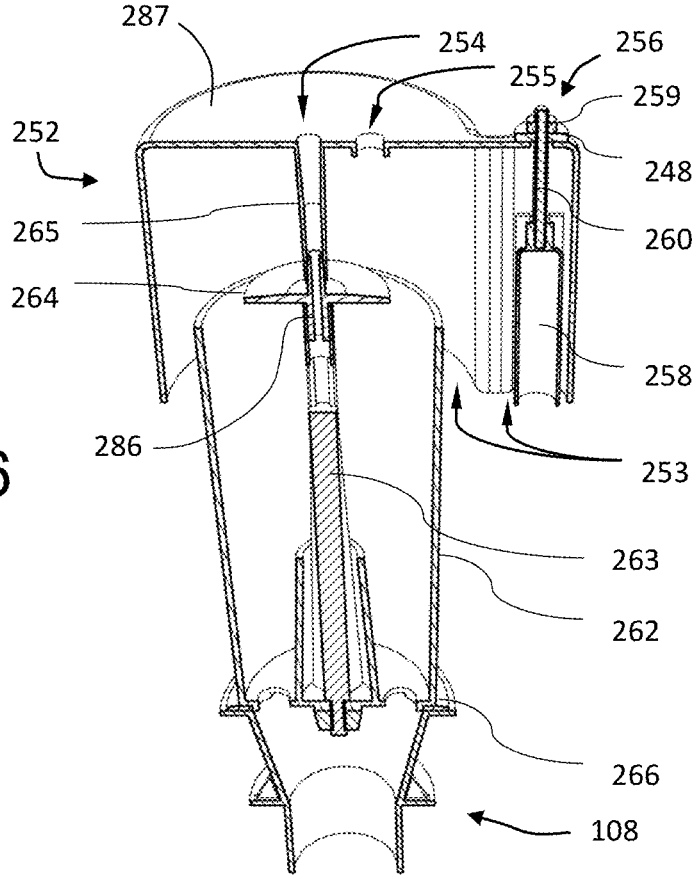
FIG. 16 is a schematic, partially cutaway, perspective view of a portion of a toilet assembly.

FIG. 14 will now be discussed, with reference to FIGS. 1-13B. FIG. 14 illustrates a modification of the intake shroud 251', which comprises a connection port 268 in the top surface 249, configured to receive an air tube 267, and tube guide 269. The connection port 268 and air tube 267 allow for selective air pressure relief during a flush event. The lower end 272 of the air tube 267 may be cut, adjusted or both so that the lower end 272 is submerged in the water just below the water fill level 410 prior to initiating a flush event. Upon initiating the flush event, as the water level in the toilet tank 103 begins to drop, the lower end 272 is unsealed immediately after the start of the flush event, which may prevent water from being sucked upward through the lower opening (gap) 253 into the air intake shroud 251'.

Figure 15:
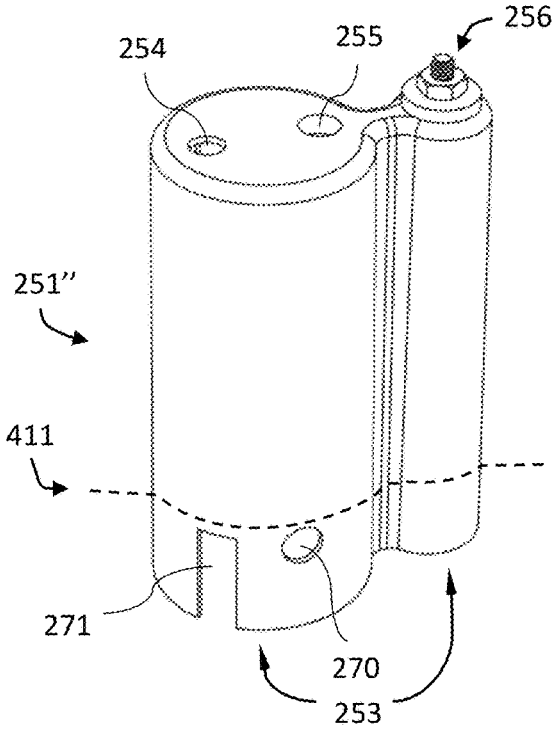
FIG. 15 is a schematic, perspective view of a portion of an air intake shroud.

FIG. 15 will now be discussed, with reference to FIGS. 1-13B. FIG. 15 illustrates a modification of the intake shroud 251", which comprises a hole 270 or slot 271 or both for air relief. The hole 270 or slot 271, as the case may be, may be located and sized so as to be fully submerged just below the water fill level 411 prior to initiation of a toilet flush event. Upon initiating the flush event, as the water level in the toilet tank 103 begins to drop, the hole 270 or slot 271, as the case may be, is immediately unsealed by the dropping water level in the toilet tank 103, which may prevent water from being sucked upward through the lower opening (gap) 253 into the air intake shroud 251".

While the air intake shroud 251 discussed above tends to work better with a toilet configuration such as that illustrated in FIGS. 2, 4 and 5, FIG. 16 illustrates a configuration of an air intake shroud 252 that may tend to work better with a toilet configuration such as that illustrated in FIG. 3. Thus, this air intake shroud 252, with similar design features and operating principle as previously described, is configured to better accommodate a canister type flush valve 108 (best seen in FIGS. 3 and 16). The shroud 252 may be positioned atop a flush valve canister guidepost 263 and may utilize an existing refill tube port 286 of the canister type flush valve 108, which refill tube port 286 may be built into a guide-post locking disk 264 of the canister type flush valve 108. The shroud 252 may mount as a male or female socket interface to secure a standoff pipe 265 at a center of the shroud 252. A refill tube port 254 may be provided in the top surface 287 of the shroud 252, which refill tube port 254 operatively engages the standoff pipe 265. The intake shroud 252 may be sized radially to accommodate the upward travel of a canister body 262 of the canister type flush valve 108 during a flush event. The standoff pipe 265 may be set at a length to assure that the upward travel of the canister body 262 during a flush event is accommodated. An air intake port 255 in the top surface 287 of the shroud 252 may be provided for, for example, a ⅜-inch O.D. tubing conduit (such as, for example, an intake air tube 222 as illustrated in other figures) leading to the intake port 206 of the air pump assembly 201 (best seen in FIG. 8). A vacuum relief valve 256 may be housed in a secondary chamber 250, with essentially the same configuration and operation as that discussed relative to FIGS. 10-13B.

FIGS. 5, 6, 17, 23, 26-28, 30 and 31 illustrate configurations for supplying electrical power to the air pump assembly 201. Electrical power may be provided to the air pump assembly 201 by, for example, being connected to an electrical wall outlet 137, which may be conventional. Electrical power may be supplied from the electrical wall outlet 137, for example, with a 120 volt alternating current (VAC) or 240 VAC and stepped down to, for example, about 12 volts direct current (VDC) via an electrical adapter (transformer) 224. The electrical adapter 224 may engage a 2-conductor, thin gage (e.g., 18, 20 or 22 gage), jacketed electrical power cable 225, routed from the location of the electrical wall outlet 137 to the air pump assembly 201. While the electrical adapter (transformer) 224 is shown connected at the point of interface with the electrical wall outlet 137, the electrical adapter 24 may be located at a different location along the electrical power cable 225 (with a generally higher gage electrical wire (e.g., 14, 16 or 18 gage) from the electrical wall outlet 137 to the electrical adapter 224). The electrical power cable 225 may connect at its other end to the electrical ports 208 of the air pump assembly 201. The electrical ports 208 may be, for example, a 2-position screw terminal power connector, and may be provided on the top face of the air pump enclosure lid 203. This provides electrical power to the air pump assembly 201, which may be employed to power the motor/pumping unit 221, the timer relay circuit board 212, the digital readout (display) 210, the operator interface buttons 211, a control switch device 240 or any combination thereof. The gage of the wire 225 or output voltage of the electrical adapter 224 or both may be increased to compensate for longer runs of the electrical power cable 225 where DC voltage drop is greater.

Figure 17:
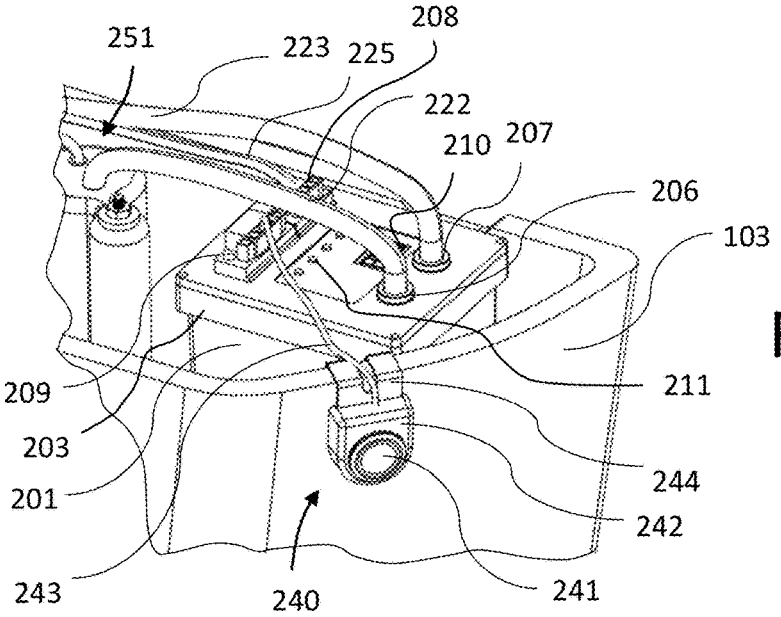
FIG. 17 is a schematic, perspective view of a portion of a toilet assembly.
Figure 18:
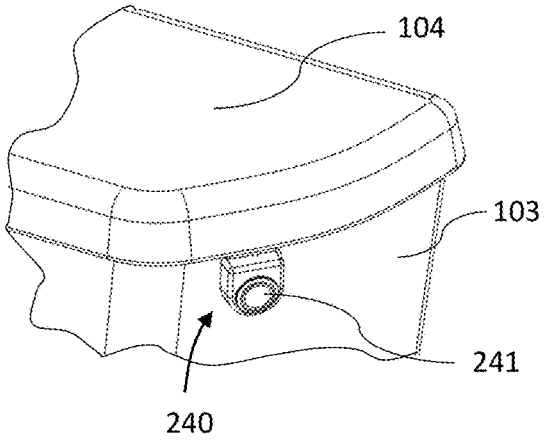
FIG. 18 is a schematic, perspective view of a portion of a toilet assembly.
Figure 19:
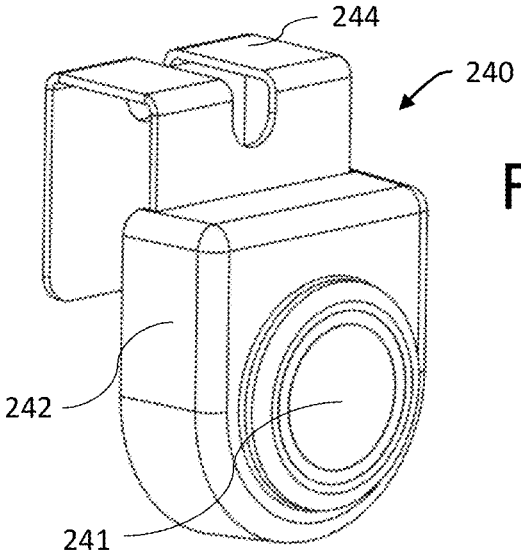
FIG. 19 is a schematic, perspective view of a button assembly of the toilet assembly.
Figure 20:
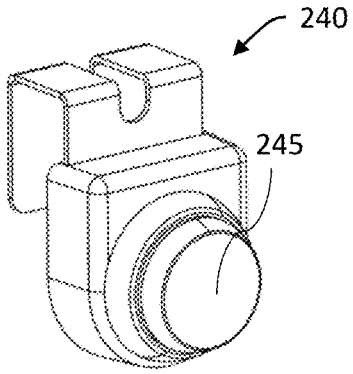
FIG. 20 is a schematic, perspective view of a button assembly of the toilet assembly.
Figure 21:
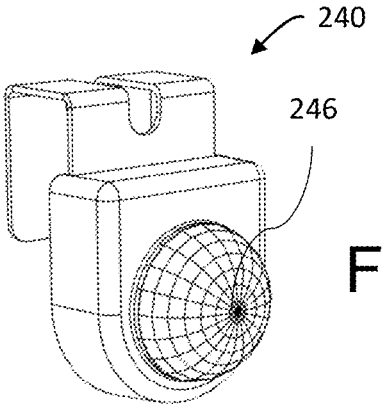
FIG. 21 is a schematic, perspective view of a button assembly of the toilet assembly.
Figure 22:
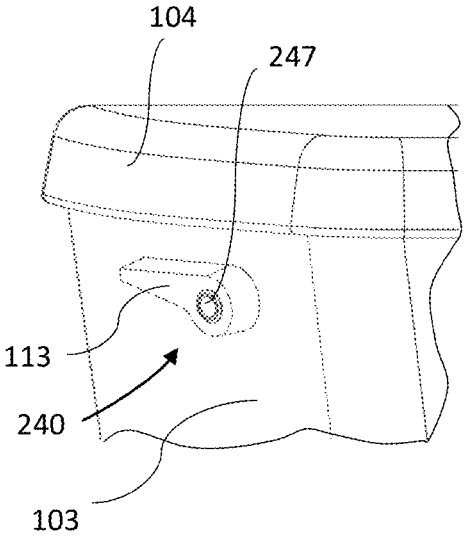
FIG. 22 is a schematic, perspective view of a portion of a toilet assembly.

The control switch device 240 will be discussed relative to FIGS. 5, 6, 8, and 17-22, in view of FIGS. 1-4. The control switch device 240 may be electrically powered by electrical ports 209, which may, for example, comprise a 4-position, screw terminal style connector. The electrical port 209 may comprise conductors, which may connect to a switch cable 243. The switch cable 243 may provide for electrical power to the control switch device 240, to power, for example a trigger signal, one or more status light(s) or both for the control switch device 240. The control switch device 240 may comprise a housing 242, which may be for example plastic, with an actuation button supported by the housing 242. The housing 242 may be affixed to a mounting clip 244, which may be secured on a top of a wall of the toilet tank 103. The mounting clip 244 may then be generally covered by the toilet tank lid 104. The control switch device 240 may comprise, for example, a touchless button with status indicators 241 for air pump idle and running modes (as illustrated in FIGS. 17-19), a mechanical button switch 245 (illustrated in FIG. 20), a motion or proximity sensor 246 (illustrated in FIG. 21), or incorporated into the flush lever 113 (illustrated in FIG. 22). In the example of the control switch device 240 being incorporated into the flush lever 113, the flush lever 113 may act as the housing 242, and without the mounting clip 244.

Referring now to FIGS. 5, 6, 8 and 17, the air pump assembly 201 may comprise the timer relay circuit board 212, which may be installed within the main housing 202 and wired to interact electrically with the electrical port 208, the electrical port 209, electrical connections to the motor/pumping unit 221, or any combination thereof. The timer relay circuit board 212 may provide for the air pump assembly 201 to execute a pre-programmed running time, executed, for example, after a trigger signal is received from the control switch device 240. The user interface buttons 211 may be employed by a user to change the amount of delay time, running time, air pump assembly operating mode or any combination thereof, to accommodate optional switches or sensors, or bypass the timer function (e.g., pre-programmed running time) altogether. The particular settings chosen by a user employing the user interface buttons 211 may be indicated on the digital readout display 210. The user interface buttons 211 may also be actuated by a user to start the motor/pumping unit 221 when main power is activated (e.g., a wall electrical switch that turns power on/off to the wall outlet 137 into which the electrical adapter 224 is plugged).

Referring now to FIGS. 2, 3, 6, 8, 17 and 18, for air pump assemblies 201 mounted in the toilet tank 103, the electrical power cable 225 and exhaust tubing 223, which may be for example ⅜ inch outside diameter (O.D.) tubing, may extend from their respective connectors 208 and 207 on top of the air pump assembly 201 through a toilet tank ventilation passage 105 to the exterior of the toilet tank 103. Typical conventional toilet tanks 103 may include such ventilation passages 105 at the top of the back tank wall, providing a natural exit point from the interior of the tank 103 to the exterior without pinching the electrical power cable 225 and exhaust tubing 223. In situations where a ventilation passage 105 is not available on a particular model of toilet to which the toilet venting system is being installed, a small, for example approximately 9 millimeter (MM) wide by 12 mm deep, cutout passage (not shown in the FIGS.) may be created at a location adjacent to or at the top of a wall of the toilet tank 103 to provide an exit point for the exhaust tube 223 and power cable 225. Such a cutout passage may be created using, for example, a rotary tool equipped with a diamond tipped cutting bit. If fabricating a cutout passage is not desired by the user for toilets not having a ventilation passage, then spacers (not shown in the FIGS.), which may be for example about ⅜ inch thick, may be secured along the top of the back wall of the toilet tank 103 to provide for an exit gap for the exhaust tube 223 and power cable 225 to extend through. The back of the toilet lid 203, then, may sit slightly higher than when resting directly on the back wall of the toilet tank 103.

Referring now to FIGS. 5, 6, 23, 26-28, the electrical power cable 225 may receive power from the electrical outlet 137, which may be for example an outlet on a ground fault circuit interrupt (GFCI) electrical circuit. A GFCI may be more desirable when the electrical outlet 137 is in relatively close proximity to the toilet 100 (best seen in FIG. 5), or when close to a source of water where the outlet 137 may potentially be exposed to moisture. For an outlet 137 that is farther from a source of water and the toilet (see for example, FIGS. 30 and 31), a longer power cable 225 run from the outlet 137 to the location of the air pump assembly 201 may be employed.

Figure 23:
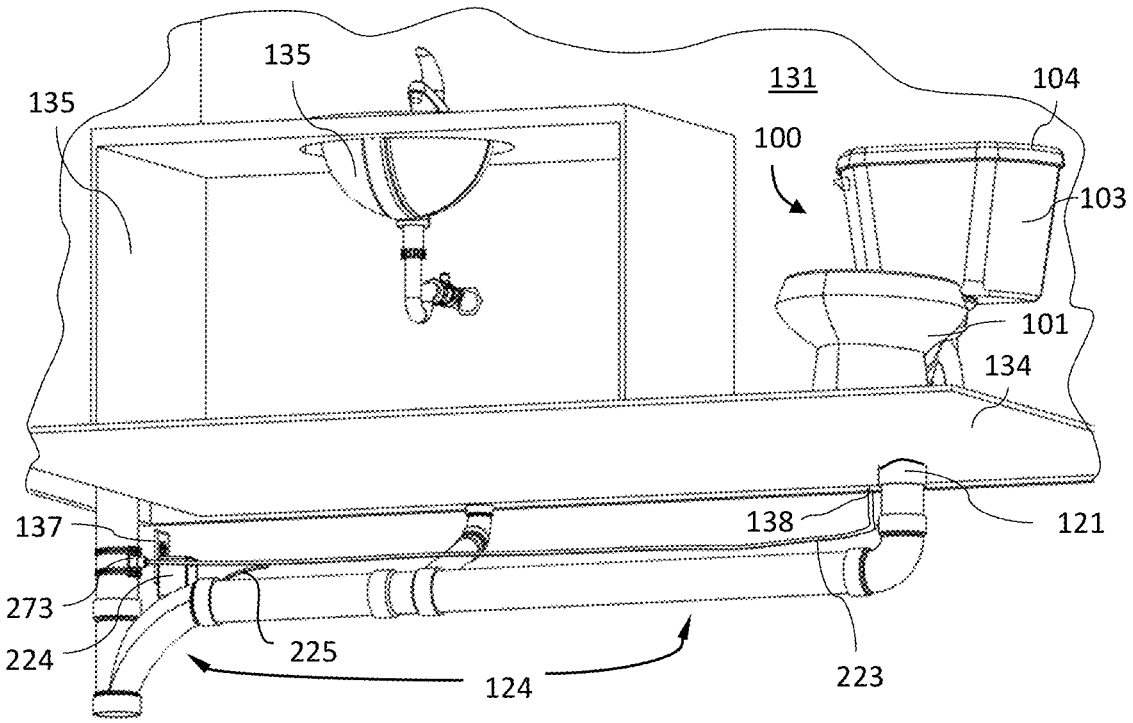
FIG. 23 is a schematic, perspective view of a toilet assembly, sink and plumbing in a room.
Figure 24:
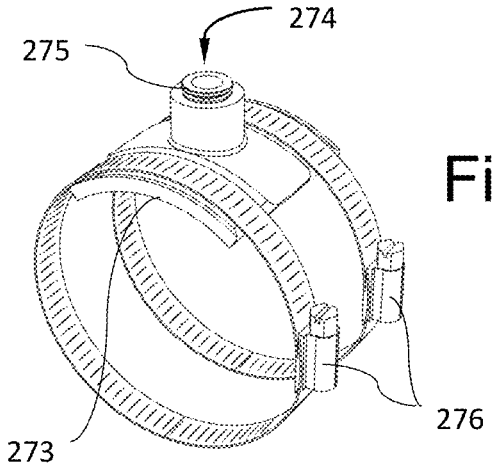
FIG. 24 is a schematic, perspective view of a connection assembly configured to connect to a plumbing drain pipe.
Figure 25:
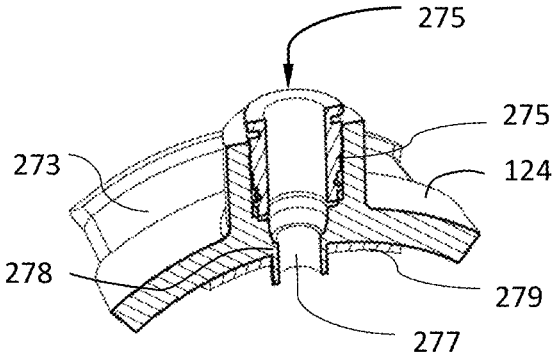
FIG. 25 is a schematic, partially cutaway, perspective view of a connection assembly connected to a plumbing drain pipe.
Figure 26:
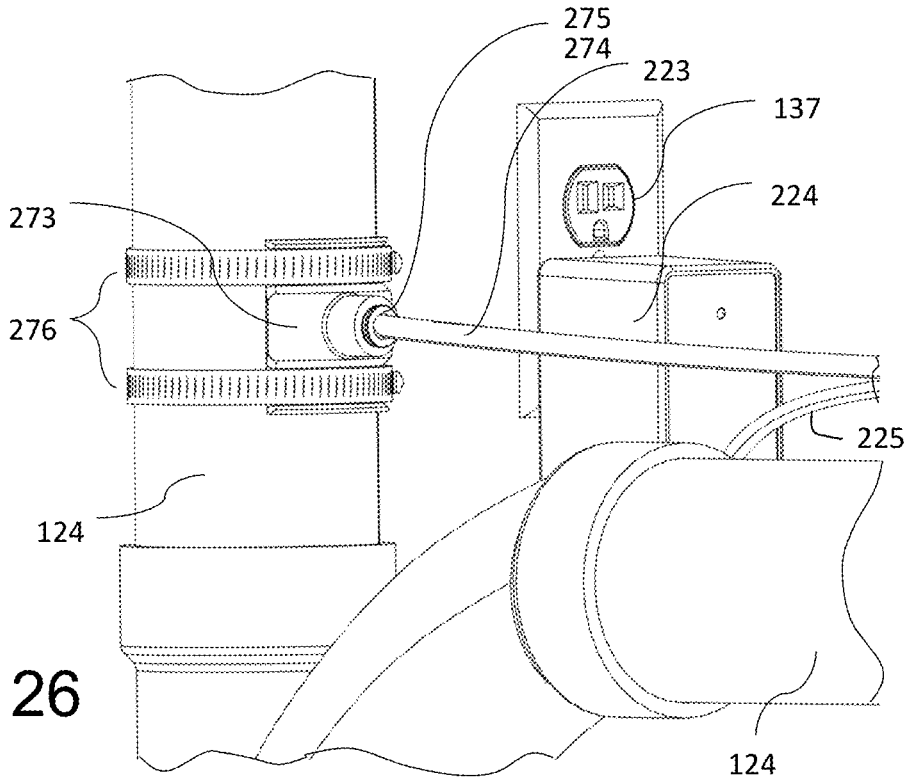
FIG. 26 is a schematic, perspective view of electrical and plumbing connections.

Referring now to FIGS. 23 and 26, in view of FIGS. 1-4, for toilets installed above a basement or crawl space, a configuration for routing the tubing 223 and electric cable 225 may be passing the tubing 223, cable 225 or both through a penetration 138, which may be for example through a wall or floor. In one example, the tubing 223 and cable 225 may follow along the toilet water supply line. In another example, the tubing 223 and cable 225 may follow along the toilet sanitary drain pipe 124. The electric cable 225 may be routed to the electrical outlet 137, operatively engaging the electrical adapter 224, which is plugged into the electrical outlet 137. The exhaust tubing 223 may be routed to a connection point along the sanitary drainage pipe 124. The location of engagement may be, for example, on a vertical main down pipe portion of the sanitary drain pipe 124 and above any tee fittings. If one connects the exhaust tubing 223 to a horizontal portion of the sanitary drain pipe 124, the connection point may be on a top side of the sanitary drain pipe 124 (see for example, FIGS. 27-29) and located away from the toilet drain or other pipe fittings that are potential obstruction or debris accumulating features.

Referring now to FIGS. 23-26, in view of FIGS. 1-4, during installation of the toilet venting system, a vent hole 278, which may be for example be a single ⅜-inch diameter hole, may be drilled into the sanitary drain pipe 124. A ventilation saddle 273, for example, may be used to connect the exhaust tubing 223 to the sanitary drain pipe 124. The ventilation saddle 273 may include a built-in cavity, which may allow for a push-to-connect assembly 275 (e.g., allowing for ⅜-inch O.D.) to be installed, which ventilation saddle 273 may be configured to fit, for example, both conventional three and four inch outside diameter sanitary drain pipes 124. During installation, a gasket 279, which may be an adhesive rubber gasket with a pass-through hole, may be located between the sanitary drain pipe 124 and the ventilation saddle 273 and may be centered on the vent hole 278 using a drain saddle air hole guide pin feature 277. During installation, the ventilation saddle 273 may be positioned directly over the vent hole 278 using the same air hole guide pin feature 277 and secured to the sanitary drain pipe 124 with, for example, two worm drive hose clamps 276. The ventilation saddle 273 may be made from, for example, thermoformed plastic, such as Acrylonitrile butadiene styrene (ABS) or polyvinylchloride (PVC), which is the same material typically used for many residential sanitary drainage pipes, allowing for the ventilation saddle 273 to be permanently attached during installations using, for example, conventional plumbing adhesive as a means of attachment. During installation, the exhaust tubing 223 may be inserted into the drain saddle push-to-connect port 274 to complete the connection of the exhaust tubing 223 to a portion of the sanitary drain pipe 124.

Figure 27:
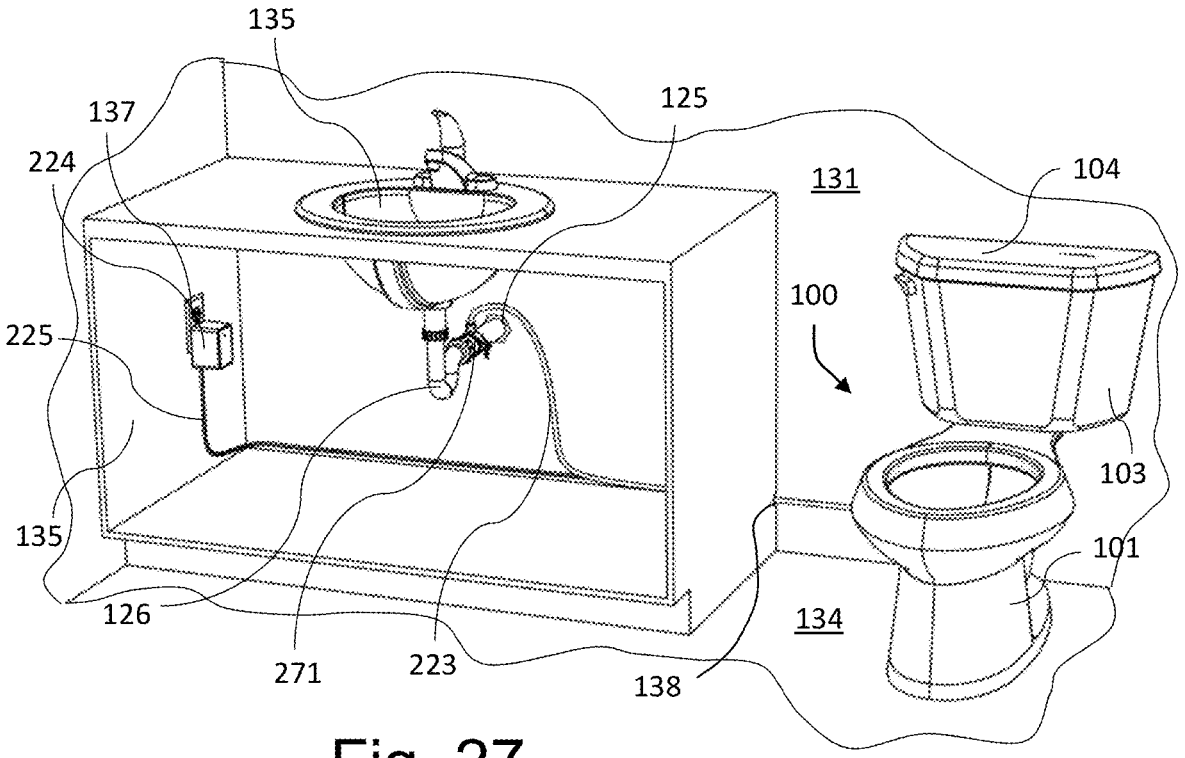
FIG. 27 is a schematic, perspective view of a toilet assembly, sink and plumbing in a room.
Figure 28:
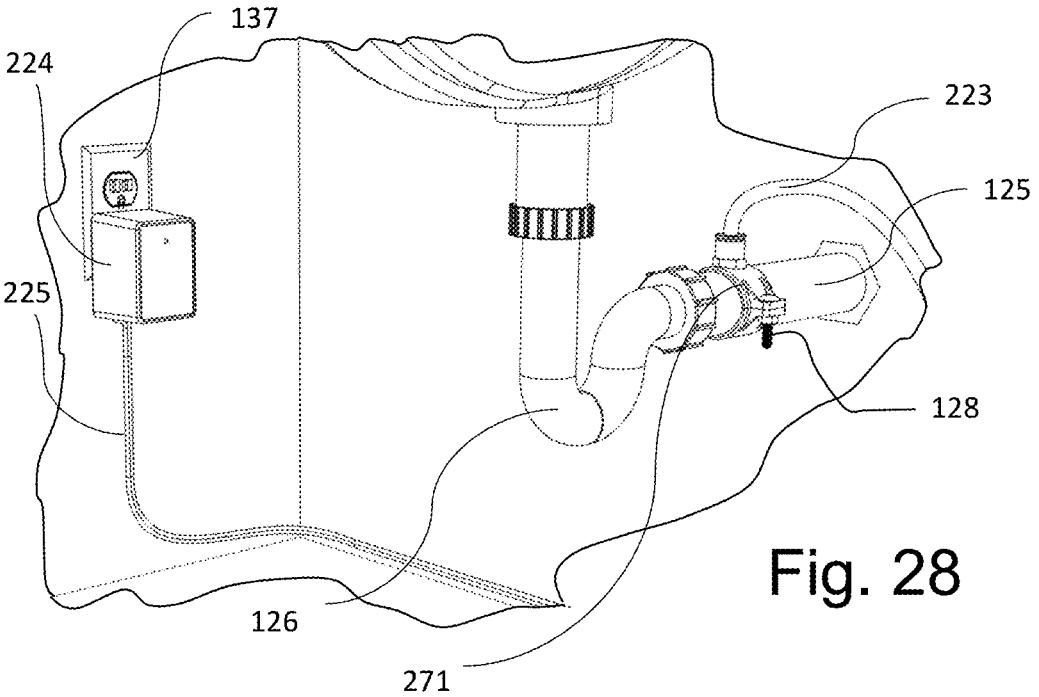
FIG. 28 is a schematic, perspective view of a portion of a toilet assembly, sink and plumbing.
Figure 29:
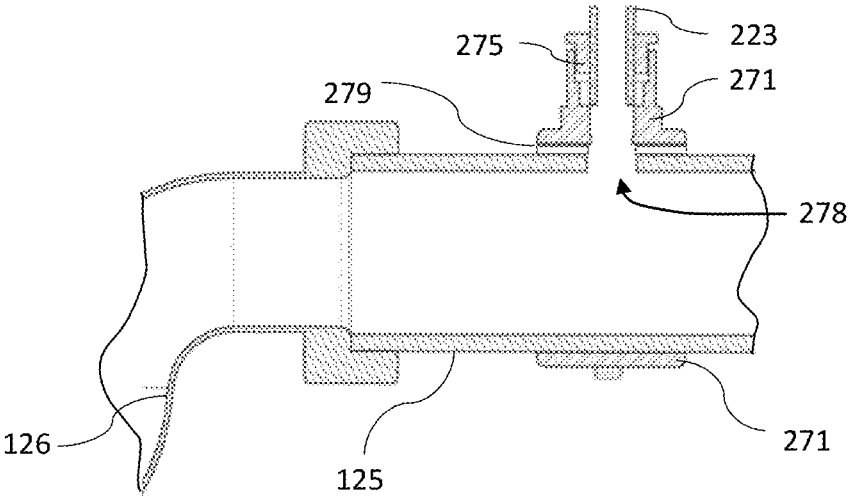
FIG. 29 is a schematic, cutaway, elevation view of a connection assembly connected to a plumbing drain pipe.
Figure 30:
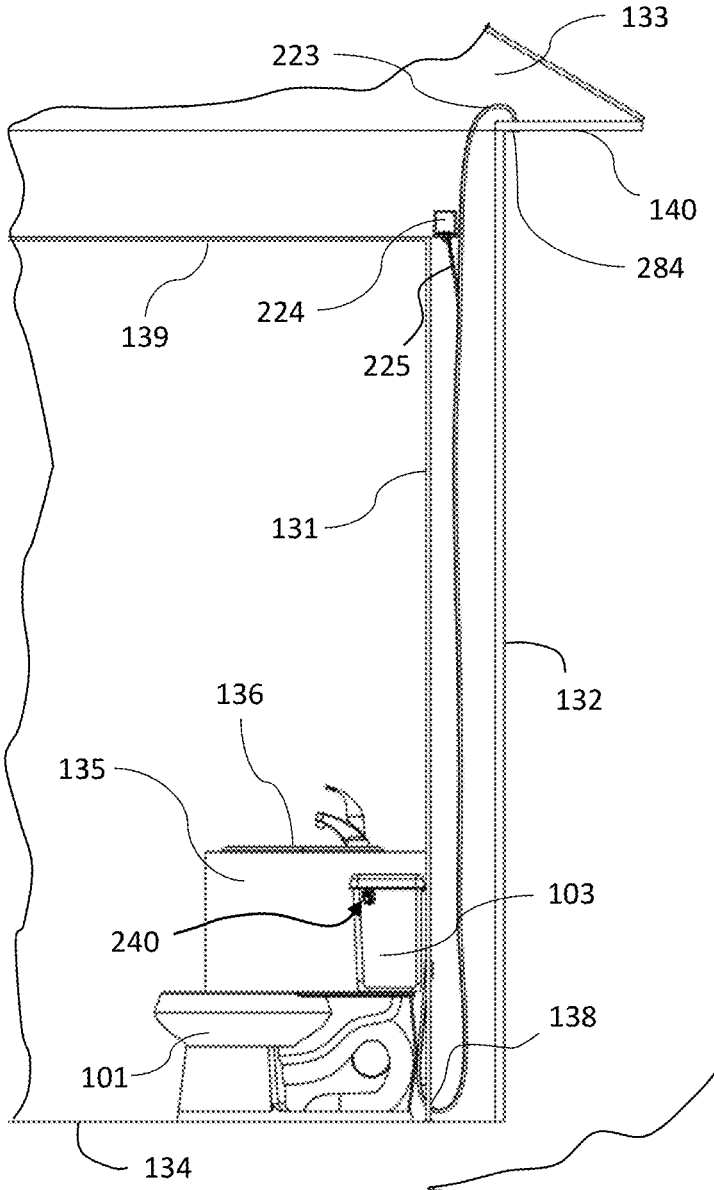
FIG. 30 is a schematic, elevation view of a toilet assembly and sink in a room.
Figure 31:
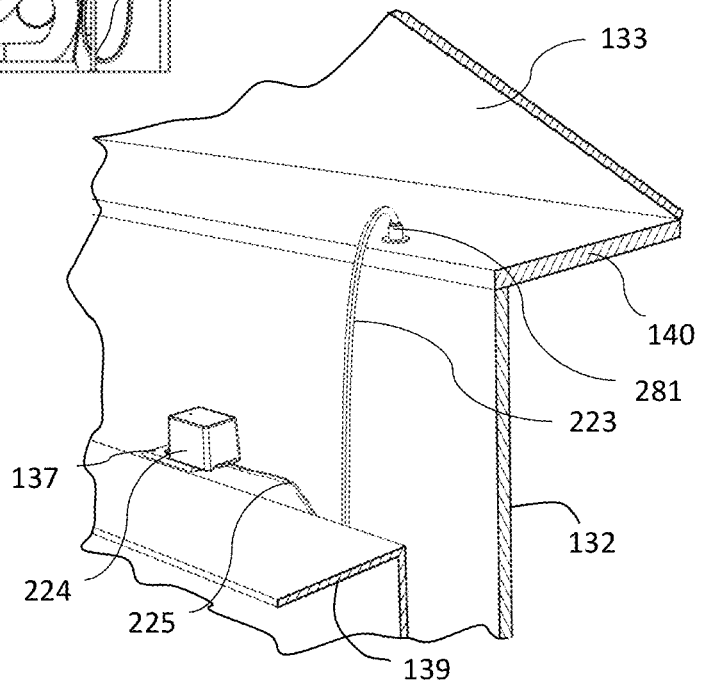
FIG. 31 is a schematic, partially cutaway, perspective view of a room and portions of a toilet assembly.

Referring now to FIGS. 27-29, in view of FIGS. 1-4, an example of a configuration of the toilet venting system with the exhaust tubing 223 engaging a sink drain 125 is illustrated. The exhaust tubing 223 and electric cable 225, for example, may be routed together during installation, sharing a common penetration 138, such as for example through walls 131 or cabinets 135, and separated to reach their intended termination points (e.g., a sanitary drain 125 or the electrical adapter 224 plugged into the electrical wall outlet 137). The electrical outlet 137 may be located, for example, inside of the cabinetry 135, such as a sink vanity. If no electrical outlet 137 is initially available in the cabinetry 135, such an electrical outlet 137 may be added inside of the cabinetry 135 by connecting, for example, to building electrical power from an electrical connection point of a nearby existing electrical outlet or existing lighting fixture located on one of the walls 131. The exhaust tubing 223 may be routed, for example, to a location immediately downstream of a sink drain P-trap 126. During installation of the toilet venting system, a vent hole 278, which may have, for example a ⅜ inch outside diameter, may be created (e.g., by drilling on a top side of a horizontal pipe section). During installation, a drain saddle 271 may be positioned over the vent hole 278 and secured to a pipe of the sink drain 125 using, for example, a sealing gasket 279 and fasteners 128. The drain saddle 271 may be, for example, a typical commercially available drain saddle, which may be configured to mate with, for example, a ⅜ inch outside diameter tubing connection and operatively engage a standard (e.g., 1 to 1½ inch drain pipe size) pipe of the sink drain 125. The drain saddle 271 may, for example, include a push-to-connect port 275, allowing for the exhaust tubing 223 to be easily inserted into and secured to the port 275 during installation.

Referring now to FIGS. 30-34, in view of FIGS. 1-4, an example of a configuration of the toilet venting system where the exhaust tubing 223 is routed to an attic 133 for direct venting to a building exterior is illustrated. During installation, the exhaust tubing 223 and electric cable 225 may be, for example, routed together, sharing common penetrations 138 through, for example, wall 131 and building structure to reach, for example, the attic space 133 above a ceiling 139 in the bathroom. The electric cable 225 may be routed to an existing electrical outlet 137 or, during installation, may be routed to a location where a new electrical outlet 137 is installed to provide electric power to the toilet ventilation system. The electrical adapter 224 may be plugged into, for example, the existing or the new electrical outlet 137. In another example, the electric cable 225 may for example plug into an outlet close to the toilet (e.g., FIG. 5). During installation, one end of the exhaust tubing 223 may be routed to a position above, for example, a roof overhang 140. This end of the exhaust tubing 223 may be secured to an end stop fitting 281, which may be for example a thermoformed plastic fitting. During installation, the end stop fitting 281 may be mounted to an end stop pipe extension 284 (illustrated in FIG. 34), which may be trimmed to, for example, a length as illustrated in FIGS. 32-33, to extend a desired distance from a bottom of the roof overhand 140. Such trimming may be accomplished after or prior to installation. During installation, a penetration 138 matching a body diameter of the end stop pipe extension 284 may be formed (e.g., by drilling) through the roof overhang 140. The end stop fitting 281 may then be inserted through the penetration 138 and may be fastened in place with, for example, a waterproof sealant or mechanical fastener (not shown).

During installation, rather than extending the exhaust tubing 223 through the roof overhang 140, the exhaust tubing 223 may be extended through a wall, e.g., the wall 131, if the wall is an external wall. The penetration through the wall 131 may be formed, for example by drilling a hole through an exterior surface 132 of the wall 131, matching a diameter of the end stop pipe extension 284. For such a configuration, a penetration may be extended through the exterior surface 132 of the wall 131. The exhaust tubing 223 may be connected to an end stop fitting (such as for example end stop fitting 281), which may be rotated about ninety degrees (from the position shown in FIG. 30) in order to extend out through the exterior surface 132, with the end stop pipe extension 284 extending to an exterior of the building. During installation, the end stop 281 may be inserted through the penetration and may be fastened in place with, for example, a waterproof sealant or mechanical fastener (not shown).

Figure 35:
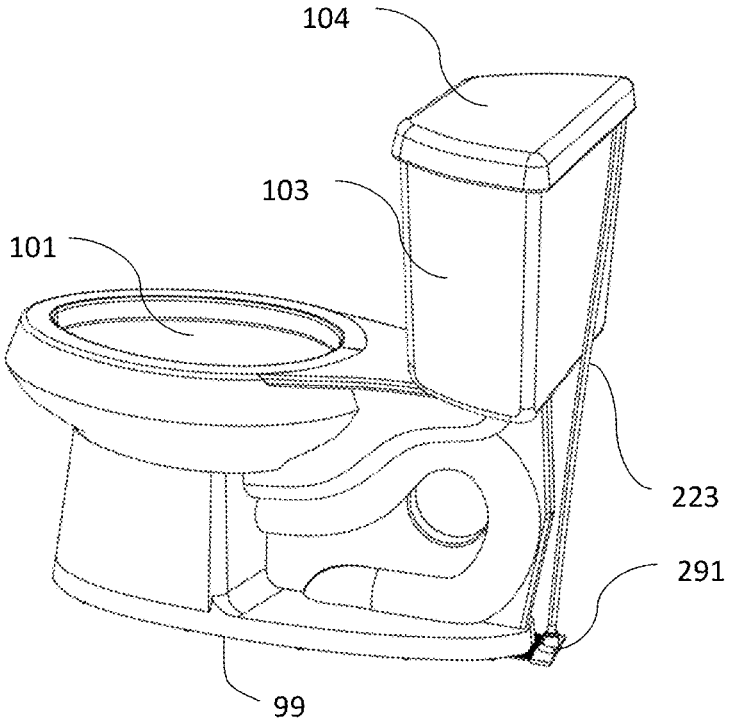
FIG. 35 is a schematic, perspective view of a portion of a toilet assembly.
Figure 36:
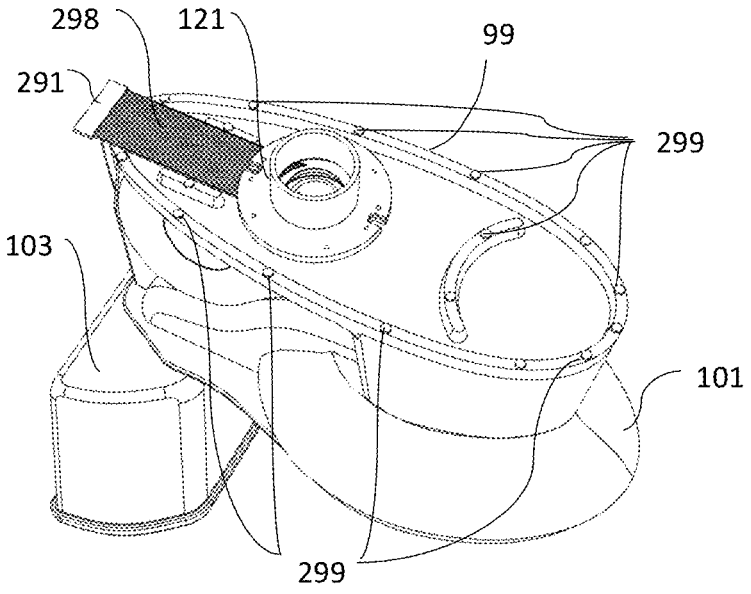
FIG. 36 is a schematic, perspective view of a portion of a toilet assembly.
Figure 37:
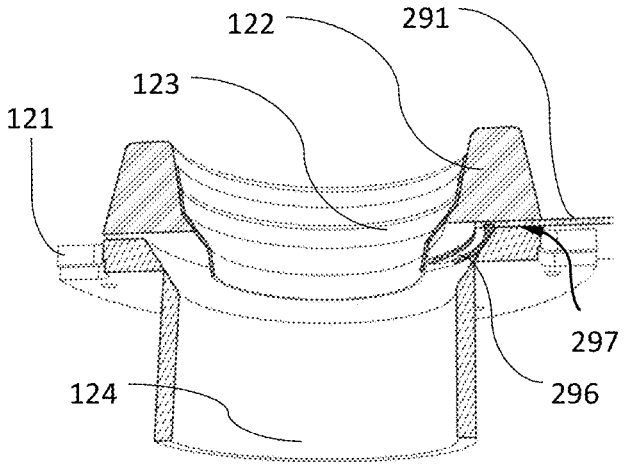
FIG. 37 is a schematic, partial cross section, perspective view of a portion of a toilet assembly.
Figure 38:
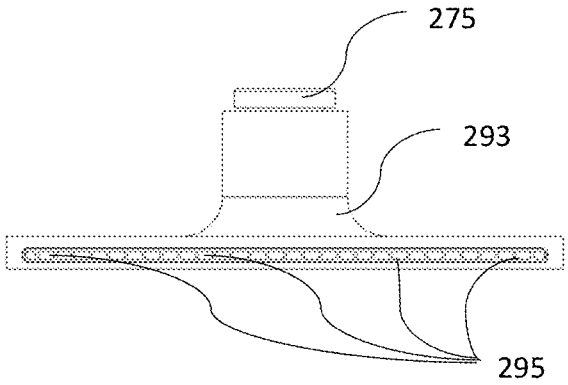
FIG. 38 is a schematic, elevation view of a portion of a toilet assembly.
Figure 39:
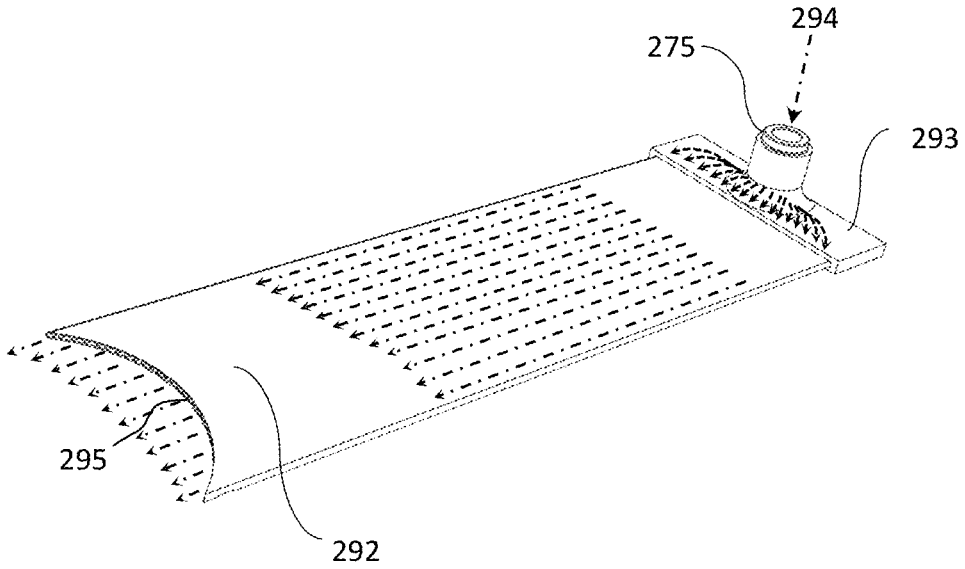
FIG. 39 is a schematic, perspective view of a microchannel housing assembly.
Figure 40:
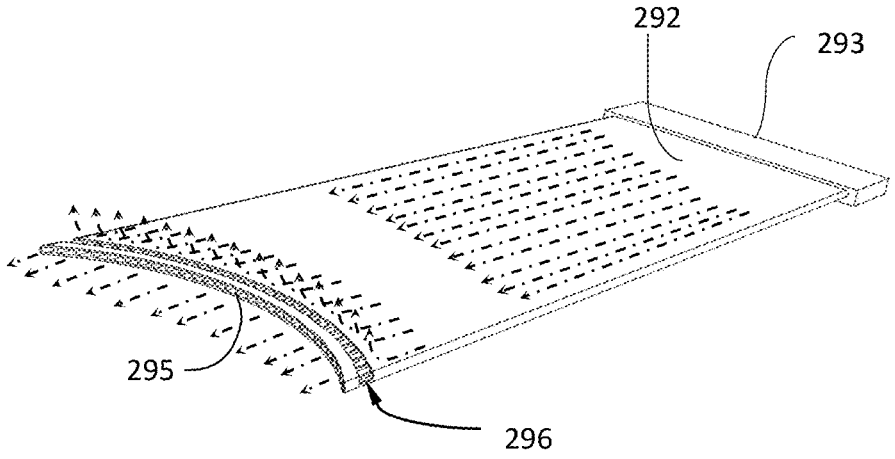
FIG. 40 is a schematic, perspective view of a microchannel housing assembly.

Referring now to FIGS. 35-40, with reference to FIGS. 1-17, a configuration of the toilet venting system is illustrated where, for locations of a toilet 100 where access to an existing drainage pipe or an exterior building wall is a less adequate solution, a toilet flange exhaust vent fitting 291 may be utilized. The toilet flange exhaust vent fitting 291 may comprise a section of a microchannel housing 292, which may be for example made of aluminum and may be an extrusion. The microchannel housing 292 may have, for example, a cross-section thickness of between about 1.5 millimeter (MM) to 3 MM and a width between about 50 MM to 100 MM. As used herein, width is in the side-to-side direction of the toilet and length is in the front-to-back direction of the toilet. One will note that, as best seen in FIGS. 35 and 36 that the width of the microchannel housing 292 may be narrower than the width of the base 99 of the toilet. This allows for the functioning of the toilet venting system while maintaining a good esthetic appeal of the toilet 100. The microchannel housing 292 may comprise a plurality of passages 295. The total cross-sectional area of the available air passages 295 for air flow may be, for example, approximately twice that of a ¼ inch inside diameter (I.D.) exhaust tubing—being twice the cross-sectional area may account for any potential air flow losses due to pinching, bending or partial blockages of the air passages 295 in the microchannel housing 292 during installation or use. Such blockages may occur, for example, from squeeze-out from a toilet wax seal 122 or other debris that may potentially accumulated during installation or use.

The fitting 291 may comprise a manifold 293, which may, for example, comprise a built-in cavity for a push-to-connect fitting 275, which may be, for example, a ⅜-inch O.D. The push-to-connect fitting 275 may operatively engage one end of the microchannel housing 292. The opposite end of the fitting 291 may be, for example, machined to a curved profile that matches an inside circular periphery of a standard toilet drain flange fitting 121. A slot 296 matching the profile of the curved profile, with a centerline slightly radially inward of the curved profile, and about half the thickness of the fitting 291 for depth of cut, may be formed, such as for example by machining, into a downward facing side of the microchannel housing 292, allowing for a secondary air escape pathway. The total length of the microchannel housing 292 may be, for example, approximately 250 MM to allow the microchannel housing 292 to extend into a toilet flange 121 by approximately 10 MM and also accommodate, for example, standard North American building guidelines for twelve inch spacing from the center of an installed toilet drain flange 121 to wall 131. During installation, a bead of sealing putty 297, for example, may be applied to the portion of the toilet drain flange 121 that will be supporting the microchannel housing 292 to provide a seal for an underside of the microchannel housing 292. The microchannel housing 292 may be able to bend to accommodate toilet drain flanges that are not flush with the flooring 134. The fitting 291 may be set in position and secured to the flooring 134 using, for example, a waterproof sealant 298 applied to the underside floor mating surface of the microchannel housing 292 and manifold 293. If the toilet is intended to be placed directly on the bathroom flooring 134 (best seen in FIGS. 5 and 27), gap spacers 299 matching the thickness of the microchannel housing 292 may be secured (e.g., using adhesive) to the underside of the base 99 to maintain even contact and prevent the microchannel housing 292 from being pinched while maintaining the esthetic appeal of the toilet after installation. The toilet 100 may then be installed following manufacturer's instructions and may employ a standard wax sealing ring 122, which may incorporate a locating flange 123.

Figure 41:
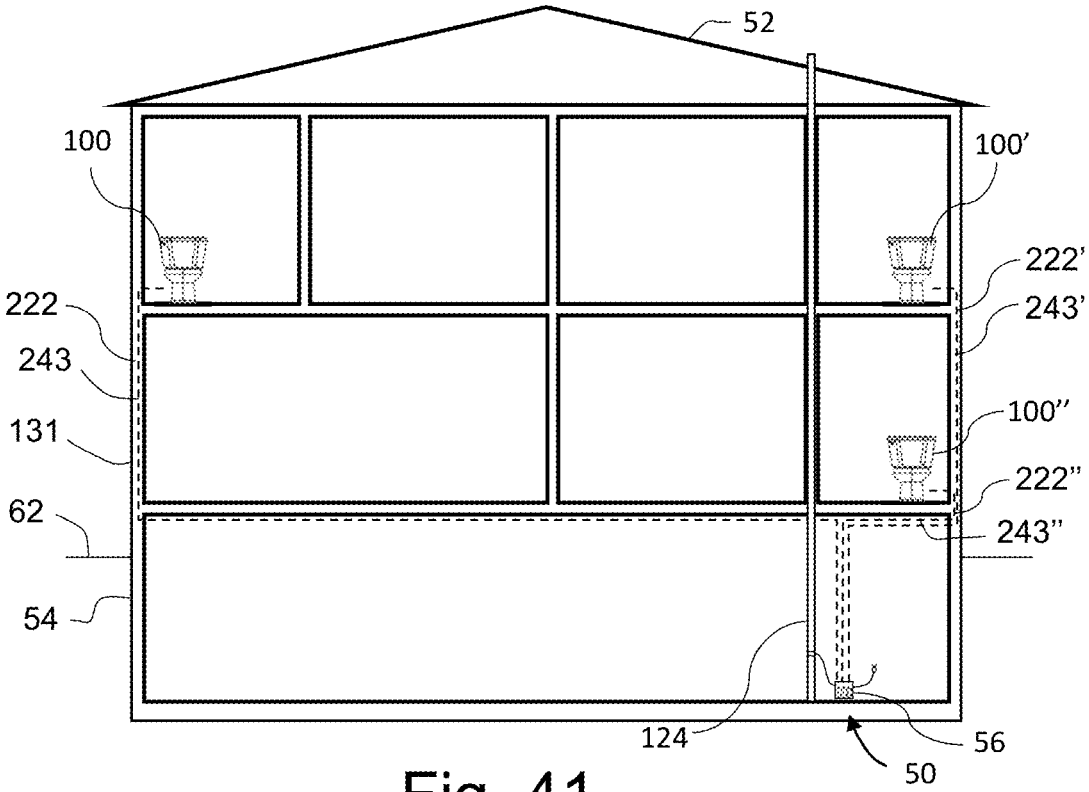
FIG. 41 is a schematic, elevation view of a building including a toilet venting system.
Figure 42:
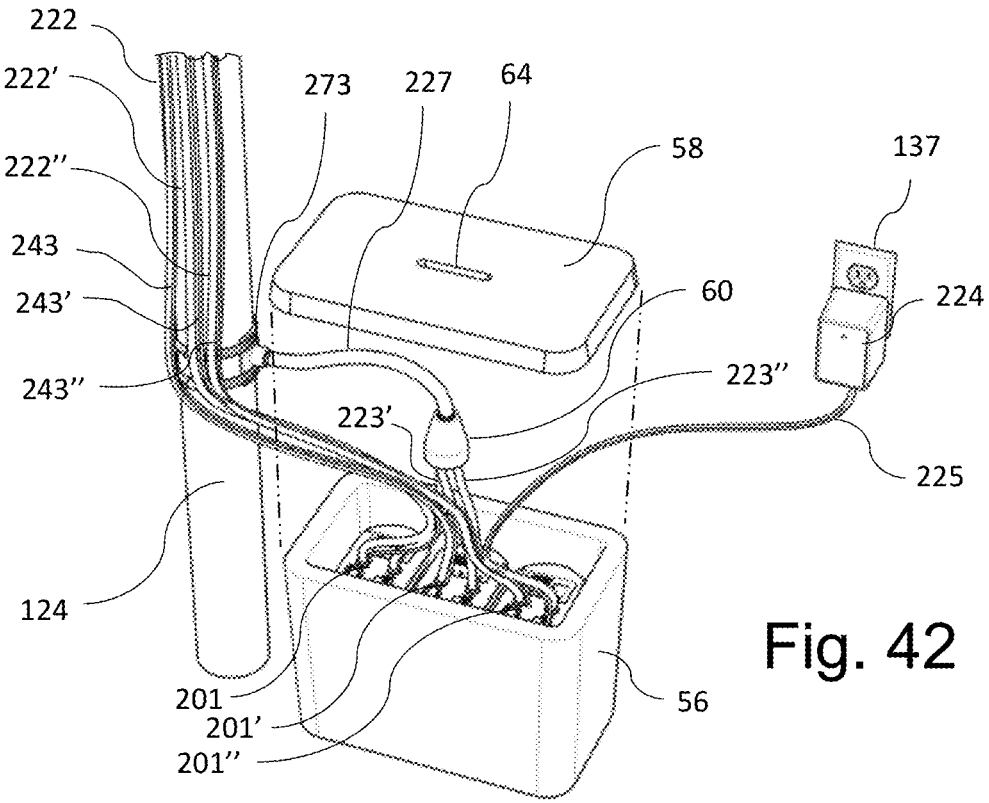
FIG. 42 is a schematic, partially exploded, perspective view of a portion of a toilet venting system installed in a building.

Referring now to FIGS. 41 and 42, with reference to FIGS. 1-40, the toilet venting system 50 may operatively engage a single toilet 100 in a building 52, multiple separate toilet venting systems 50 may each operatively engage a single toilet 100 in the building 52, or the toilet venting system 50 may operatively engage multiple toilets 100, 100', 100" in the building 52. The building 52 may be, for example, a house, which may have multiple bathrooms, which may be on multiple floors of the house. FIGS. 41 and 42 are directed to the example illustrating the toilet venting system 50 operatively engaging three toilets 100, 100' and 100" in the building 52, which in this example may have a basement 54 (although a basement is not needed for this example of the toilet venting system 50 to operate. While the example illustrated of the toilet venting system 50 shows three toilets, the toilet venting system 50 may operatively engage more than three toilets. For all three toilets 100, 100' and 100" in this example, each may have an air intake shroud 251 located in the respective toilet (e.g., as illustrated in FIGS. 4-7, 13A. 13B, 16 and 17) and a control switch device 240 mounted to or located adjacent to the respective toilet (e.g., as illustrated in FIGS. 5, 6, 17-22 and 30).

The first toilet 100 operatively engages an air intake tube 222 and a switch cable 243. The air intake tube 222 may operatively engage the corresponding air intake shroud 251, and the switch cable 243 may operatively engage the corresponding control switch device 240. The air intake tube 222 and switch cable 243 may extend through a penetration 138 in a wall 131 (which may be an interior or exterior wall), floor 134 or both (as illustrated in other figures herein), to a remote central (common) location, such as for example to a multi-air pump assembly housing 56, which may for example be located in the basement 54 (or another floor). The second toilet 100' operatively engages an air intake tube 222' and a switch cable 243'. The air intake tube 222' may operatively engage the corresponding air intake shroud 251, and the switch cable 243' may operatively engage the corresponding control switch device 240. The air intake tube 222' and the switch cable 243' may extend to the central location, for example to the multi-air pump assembly housing 56, in a similar manner as regarding the first toilet. The third toilet 100" operatively engages an air intake tube 222" and a switch cable 243". The air intake tube 222" may operatively engage the corresponding air intake shroud 251, and the switch cable 243" may operatively engage the corresponding control switch device 240. The air intake tube 222" and the switch cable 243" may extend to the central location, for example to the multi-air pump assembly housing 56, in a similar manner as regarding the first toilet.

The multi-air pump assembly housing 56 may contain one or more air pump assemblies. In the particular example illustrated in FIG. 42, three air pump assemblies 201, 201' and 201" are located in the multi-air pump assembly housing 56. The air intake tube 222 may operatively engage the external intake port 206 of the air pump assembly 201 (as illustrated in FIGS. 5-8, 13A, 13B and 17), and the switch cable 243 may operatively engage the electrical port 209 (as illustrated in FIGS. 5, 6 and 17). Similar connections to ports on air pump assemblies 201' and 201" may be employed for respective air intake tubes 222' and 222" as well as switch cables 243' and 243". Alternatively, one high capacity air pump assembly may be employed with the air intake tubes and switch cables operatively engaging the high capacity air pump assembly.

In the particular example illustrated in FIG. 42, each air pump assembly 201, 201' and 201" may include an exhaust port 207 (as illustrated in FIGS. 6, 8 and 17) operatively engaging a respective exhaust tubing (only two illustrated in FIG. 42, 223' and 22"). The opposite end of each exhaust tubing from its respective exhaust port may be joined at an air manifold 60, combining the exhaust air flow into a combined exhaust tubing 227. The combined exhaust tubing 227 may then operatively engage a ventilation saddle 273 (as illustrated in FIGS. 23-29). Alternatively, the combined exhaust tubing 227 may be directed out of the building (as illustrated in FIGS. 30-34). Electrical power may be supplied from a wall outlet 137 to an electrical adapter 224, one for each air pump assembly 201, 201' and 201" or one that supplies electrical power to all of the air pump assemblies.

The multi-air pump assembly housing 56 may provide for sound dampening to reduce noise emitted from the air pump assemblies 201, 201' and 201". A housing lid 58, which may be removable, may be secured to the housing 56 and may also provide sound dampening. The lid 58 may include an opening 64 that allows for the various tubing and electrical wiring to pass through into the housing 56.

In another embodiment, a toilet assembly may be delivered directly from the manufacturer with a prepared tubing connection port incorporated into the body of the toilet bowl 101 that provides an air exhaust passage into the toilet drainage channel 115 (best seen in FIG. 4). This can be delivered to the customer with a removable plug so that an exhaust tubing conduit 223 may be easily connected to interface with the air extraction apparatus.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A kit for removing malodorous air from at least one toilet, the kit comprising:

an intake shroud configured to operatively couple to a tank overflow pipe in a toilet tank, which intake shroud has sides configured to surround an upper portion of the tank overflow pipe and a top surface configured to be supported above a top of the tank overflow pipe to create an internal air chamber between the tank overflow pipe and the intake shroud, and a water refill tube port and an air intake port extending through the intake shroud at a location configured to extend into the internal air chamber and configured to be located above the top of the tank overflow pipe;

at least one air pump assembly, configured to receive electrical power to drive an air pump and electronics controlling the air pump, which at least one air pump assembly includes an air intake port for drawing the malodorous air into the air pump;

a flexible intake air tube having a first end operatively engaging the air intake port of the intake shroud and an opposed second end operatively engaging the air intake port of the at least one air pump assembly; and wherein the intake shroud comprises a vacuum air relief valve operatively engaging a vacuum relief port extending through the intake shroud and configured to extend into the internal air chamber, the vacuum air relief valve configured to open when a water level in the toilet tank rises above a predetermined level and close when the water level in the toilet tank drops below the predetermined level.

2. The kit of claim 1 wherein the flexible air intake tube is long enough to extend to the air pump assembly when the air pump assembly is mounted in the toilet tank.

3. The kit of claim 1 wherein the flexible air intake tube is long enough to extend to the air pump assembly when the air pump assembly is mounted in a different room from the toilet.

4. The kit of claim 1 further comprising:

a second intake shroud configured to operatively couple to a second tank overflow pipe in a second toilet tank of a second toilet, which second intake shroud has second sides configured to surround a second upper portion of the second tank overflow pipe and a second top surface configured to be supported above a top of the second tank overflow pipe to create a second internal air chamber between the second tank overflow pipe and the second intake shroud, and a second water refill tube port and a second air intake port extending through the second intake shroud at a location configured to extend into the second internal air chamber and configured to be located above the top of the second tank overflow pipe; and a second flexible intake air tube having a first end operatively engaging the second air intake port of the second intake shroud and an opposed second end operatively engaging a second air intake port of at least one second air pump assembly, wherein the at least one air pump assembly and the at least one second air pump assembly are configured to be located in a room different from a first room in which a first toilet is located and a second room in with the second toilet is located, and wherein the flexible intake air tube and the second flexible intake air tube are long enough to extend from the respective first and second toilets to the room in which the at least one air pump assembly and the at least one second air pump assembly will be located.

5. The kit of claim 4 further comprising a first air exhaust tubing operatively engaging the at least one air pump assembly to direct malodorous air from the at least one air pump assembly, a second air exhaust tubing operatively engaging the at least one second air pump assembly to direct malodorous air from the at least one second air pump assembly, and an air manifold for operatively engaging the first and second air exhaust tubing to receive and direct malodorous air away from the at least one air pump assembly and the at least one second air pump assembly.

6. The kit of claim 4 further including an air pump assembly housing within which the at least one air pump assembly and the at least one second air pump assembly are contained, with the air pump assembly housing configured to provide sound dampening to dampen sound from the at least one air pump assembly and the at least one second air pump assembly emanating from the air pump assembly housing.

7. The kit of claim 4 further including a first control switch device that selectively activates the at least one air pump assembly, a first switch cable operatively engaging the first control switch device to the at least one air pump assembly, a second control switch device that selectively activates the at least one second air pump assembly, and a second switch cable operatively engaging the second control switch device to the at least one second air pump assembly.

8. The kit of claim 1 further comprising a control switch device operatively engaging the at least one air pump assembly to selectively activate the at least one air pump assembly.

9. The kit of claim 8 wherein the control switch device comprises a bracket configured to mount on top of a wall of the toilet tank, the bracket configured to be movable to multiple locations along the wall of the toilet tank.

10. The kit of claim 8 wherein the control switch device comprises a light configured to illuminate a switch for activating the at least one air pump assembly.

11. The kit of claim 1 wherein the electronics controlling the air pump are mounted to a housing containing the air pump, have controls for a user to selectively change timing of operation of the at least one pump, and the controls are configured to be contained with the air pump within the toilet tank and configured to be accessible by removing a toilet tank lid from on top of the toilet tank.

12. The kit of claim 11 wherein the electronics controlling the air pump comprise a digital display that is mounted to the housing containing the air pump, indicates current settings for the air pump operation, and is configured to be viewed from within the toilet tank when the toilet tank lid is removed from the toilet tank.

13. The kit of claim 1 further comprising a flexible exhaust air tubing extending to a sanitary drain pipe and a connector configured to sealingly connect flexible exhaust air tubing to inside of the sanitary drain pipe to direct malodorous air from the at least one air pump to the sanitary drain pipe.

14. The kit of claim 1 further comprising flexible exhaust air tubing configured to extend to outside of a building within which the toilet is located, and an end stop fitting configured to seal the flexible exhaust air tubing to outside structure of the building in which the toilet is located.

15. The kit of claim 1 further comprising:

a toilet flange exhaust vent fitting having a microchannel structure and configured to be mounted under a base of a toilet bowl, in which the microchannel structure is configured to be narrower than a width of the base of the toilet bowel, wherein the toilet flange exhaust vent fitting is configured to direct malodorous air to a sanitary drain pipe under the toilet; and a flexible exhaust air tubing extending from the at least one air pump assembly to the toilet flange exhaust vent fitting.

16. The kit of claim 1 further comprising an electrical adapter configured to operatively engage an electrical wall outlet and an electric power cable extending from the electrical adapter to the at least one pump assembly to provide electrical power to the at least one pump assembly.

17. The kit of claim 1 further comprising an air tube having a first end extending through a port in the top surface of the intake shroud and a distal second end extending along the sides of the intake shroud to a lower end that is configured to extend adjacent to and below a water level when water in the toilet tank is filled to a predetermined level between toilet flush events.

18. The kit of claim 1 wherein the air pump is at least one diaphragm pump.

19. The kit of claim 1 wherein the air pump includes at least one valve that prevents backflow of malodorous air to the intake shroud.

20. The kit of claim 1 wherein the intake shroud comprises internal supports extending within the side and configured to engage the tank overflow pipe to maintain the top surface of the intake shroud a predetermined distance above the top of the tank overflow pipe.

21. A kit for removing malodorous air from at least one toilet, the kit comprising:

an intake shroud configured to operatively couple to a tank overflow pipe in a toilet tank, which intake shroud has sides configured to surround an upper portion of the tank overflow pipe and a top surface configured to be supported above a top of the tank overflow pipe to create an internal air chamber between the tank overflow pipe and the intake shroud; a water refill tube port and an air intake port extending through the intake shroud at a location configured to extend into the internal air chamber and configured to be located above the top of the tank overflow pipe; a vacuum relief port extending through the intake shroud and configured to extend into the internal chamber; and a vacuum air relief valve operatively engaging the vacuum relief port and configured to open when a water level in the toilet tank rises above a predetermined level and close when the water level in the toilet tank drops below the predetermined level;

at least one air pump assembly, configured to receive electrical power to drive an air pump and electronics controlling the air pump, which at least one air pump assembly includes an air intake port for drawing the malodorous air into the air pump; and a conduit having a first end operatively engaging the air intake port of the intake shroud and a second end operatively engaging the air intake port of the at least one air pump assembly.

22. The kit of claim 21 wherein the vacuum air relief valve comprises a float that is mounted within the sides of the intake shroud and is configured to float on the water in the toilet tank, an adjustable rod extending from the float through the top surface, and a seal mounted to the adjustable rod above the top surface and configured to move up and down with the float such that, when the float drops with the water level in the toilet tank the seal seals the vacuum relief port and when the water level rises to or above a predetermined level the float and rod push the seal off of the vacuum relief port, unsealing the vacuum relief port.

23. A kit for removing malodorous air from at least one toilet, the kit comprising:

an intake shroud configured to operatively couple to a tank overflow pipe in a toilet tank, which intake shroud has sides configured to surround an upper portion of the tank overflow pipe and a top surface configured to be supported above a top of the tank overflow pipe to create an internal air chamber between the tank overflow pipe and the intake shroud, and a water refill tube port and an air intake port extending into the internal air chamber and configured to be located above the top of the tank overflow pipe;

at least one air pump assembly, configured to receive electrical power to drive an air pump and electronics controlling the air pump, which at least one air pump assembly includes an air intake port for drawing the malodorous air into the air pump;

a conduit having a first end operatively engaging the air intake port of the intake shroud and an opposed second end operatively engaging the air intake port of the at least one air pump assembly;

a toilet flange exhaust vent fitting having a microchannel structure and configured to be mounted under a base of a toilet bowl, in which the microchannel structure is configured to be narrower than a width of the base of the toilet bowel, wherein the toilet flange exhaust vent fitting is configured to direct malodorous air to a sanitary drain pipe under the toilet, and wherein the microchannel structure comprises a generally flat plate having a plurality of parallel extending channels extending therethrough; and an exhaust air tubing extending from the at least one air pump assembly to the toilet flange exhaust vent fitting.

24. The kit of claim 23 wherein the toilet flange exhaust fitting comprises a manifold operatively engaging the exhaust air tubing and configured to distribute malodorous air throughout the microchannel structure.

25. The kit of claim 23 wherein the microchannel structure comprises an aluminum extrusion having total cross-sectional area of air passages that is about twice that of a cross sectional area of an inside of the exhaust air tubing.

26. The kit of claim 23 further comprising gap spacers configured to mount to an underside of the base of the toilet bowl to raise the toilet bowl from a mounting location to reduce or eliminate crushing of the microchannel structure when the toilet is mounted for use.

27. A toilet venting system comprising:

an intake shroud operatively engaging a tank overflow pipe in a toilet tank, which intake shroud has sides surrounding an upper portion of the tank overflow pipe and a top surface supported above a top of the tank overflow pipe to create an internal air chamber between the tank overflow pipe and the intake shroud, and a water refill tube port and an air intake port extending through the intake shroud extending into the internal air chamber and located above the top of the tank overflow pipe;

at least one air pump assembly, configured to receive electrical power to drive an air pump and electronics controlling the air pump, which at least one air pump assembly includes an air intake port for drawing the malodorous air into the air pump, and wherein the at least one air pump assembly is mounted in the toilet tank at least partially submerged within water contained in the toilet tank; and a flexible intake air tube having a first end connected to the air intake port of the intake shroud and an opposed second end connected to the air intake port of the at least one air pump assembly and wherein the electronics controlling the air pump are mounted to a housing containing the air pump, have controls for a user to selectively change timing of operation of the at least one pump, and the controls are contained with the air pump within the toilet tank and accessible by removing a toilet tank lid from on top of the toilet tank.

28. The toilet venting system of claim 27 wherein the intake shroud comprises a vacuum air relief valve operatively engaging a vacuum relief port extending through the intake shroud into the internal air chamber, the vacuum air relief valve configured to open when a water level in the toilet tank rises above a predetermined level and close when the water level in the toilet tank drops below the predetermined level.

29. The toilet venting system of claim 27 further comprising:

a toilet flange exhaust vent fitting having a microchannel structure and mounted under a base of a toilet bowl, in which the microchannel structure is narrower than a width of the base of the toilet bowel, wherein the toilet flange exhaust vent fitting is configured to direct malodorous air to a sanitary drain pipe under the toilet bowl; and a flexible exhaust air tubing extending from the at least one air pump assembly to the toilet flange exhaust vent fitting.

30. The toilet venting system of claim 27 wherein the air pump is at least one diaphragm pump.

* * * * *